US011228105B2

(12) United States Patent
Yun et al.

(10) Patent No.: US 11,228,105 B2
(45) Date of Patent: Jan. 18, 2022

(54) ELECTRONIC DEVICE COMPRISING ANTENNA

(71) Applicant: Samsung Electronics Co., Ltd., Gyeonggi-do (KR)

(72) Inventors: Su Min Yun, Gyeonggi-do (KR); Myung Hun Jeong, Gyeonggi-do (KR); Je Hun Jong, Gyeonggi-do (KR); Jae Hoon Jo, Gyeonggi-do (KR); Se Hyun Park, Gyeonggi-do (KR); Jae Bong Chun, Gyeonggi-do (KR)

(73) Assignee: Samsung Electronics Co., Ltd

( * ) Notice: Subject to any disclaimer, the term of this patent is extended or adjusted under 35 U.S.C. 154(b) by 163 days.

(21) Appl. No.: 16/202,773

(22) Filed: Nov. 28, 2018

(65) Prior Publication Data

US 2019/0165473 A1 May 30, 2019

(30) Foreign Application Priority Data

Nov. 28, 2017 (KR) ..... 10-2017-0160536

(51) Int. Cl.
*H01Q 1/24* (2006.01)
*H01Q 5/50* (2015.01)
(Continued)

(52) U.S. Cl.
CPC ..... *H01Q 5/50* (2015.01); *H01Q 1/243* (2013.01); *H01Q 1/42* (2013.01); *H01Q 1/44* (2013.01);
(Continued)

(58) Field of Classification Search
CPC ..... H01Q 5/50; H01Q 21/062; H01Q 1/42; H01Q 21/065; H01Q 1/44; H01Q 21/0025; H01Q 21/28; H01Q 1/243; H01Q 9/0407
See application file for complete search history.

(56) References Cited

U.S. PATENT DOCUMENTS 6,046,707 A * 4/2000 Gaughan ..... H01Q 1/243 343/872
7,002,520 B2 2/2006 Bae
(Continued)

FOREIGN PATENT DOCUMENTS

CN 102377021 3/2012
CN 104577317 4/2015
(Continued)

OTHER PUBLICATIONS

Zhen-guo Liu, "Fabry-Perot Resonator Antenna", XP055509473, Journal of Infrared, Millimeter and Terahertz Waves, Jan. 1, 2010, 13 pages.
(Continued)

*Primary Examiner* — Dieu Hien T Duong
(74) *Attorney, Agent, or Firm* — The Farrell Law Firm, P.C.

(57) ABSTRACT

An electronic device is provided. The electronic device includes a housing including a first plate, a second plate facing the first plate and spaced from the first plate, and a side member surrounding a space between the first plate and the second plate, wherein the second plate includes a non-conductive material, at least one antenna element positioned within the space and positioned on a substrate parallel to the second plate, wherein the at least one antenna element is spaced from the second plate by a gap h, and a wireless communication circuit electrically connected to the antenna element and configured to transmit and/or receive a signal
(Continued)

with a frequency between 20 GHz and 100 GHz and a wavelength corresponding to the frequency, wherein the gap h corresponds to $$\frac{n\lambda}{2},$$

wherein n is an integer and λ is the wavelength.

17 Claims, 28 Drawing Sheets

(51) Int. Cl.

| | |
|---|---|
| ***H01Q 21/28*** | (2006.01) |
| ***H01Q 9/04*** | (2006.01) |
| ***H01Q 21/06*** | (2006.01) |
| ***H01Q 1/42*** | (2006.01) |
| ***H01Q 1/44*** | (2006.01) |
| ***H01Q 21/00*** | (2006.01) |

(52) U.S. Cl.
CPC ..... *H01Q 9/0407* (2013.01); *H01Q 21/0025* (2013.01); *H01Q 21/062* (2013.01); *H01Q 21/065* (2013.01); *H01Q 21/28* (2013.01)

(56) References Cited

U.S. PATENT DOCUMENTS

| | | | | |
|---|---|---|---|---|
| 8,760,349 | B2 | 6/2014 | Konanur et al. | |
| 8,884,827 | B2 | 11/2014 | Satoh et al. | |
| 8,912,957 | B2 | 12/2014 | Lin | |
| 9,160,061 | B2 | 10/2015 | Konanur et al. | |
| 9,583,817 | B2 | 2/2017 | Watanabe et al. | |
| 9,601,823 | B2 | 3/2017 | Konanur et al. | |
| 9,627,742 | B2 | 4/2017 | Konanur et al. | |
| 9,667,290 | B2 | 5/2017 | Ouyang et al. | |
| 9,728,858 | B2 | 8/2017 | Zhu et al. | |
| 9,766,330 | B2 | 9/2017 | Nagaishi et al. | |
| 10,084,490 | B2 | 9/2018 | Ouyang et al. | |
| 10,418,687 | B2 | 9/2019 | Mow et al. | |
| 10,680,663 | B2 | 6/2020 | Ouyang et al. | |
| 2002/0041254 | A1* | 4/2002 | Nakano | H01Q 9/0407 343/700 MS |
| 2004/0145524 | A1 | 7/2004 | Bae | |
| 2012/0044113 | A1 | 2/2012 | Satoh et al. | |
| 2012/0133561 | A1 | 5/2012 | Konanur et al. | |
| 2013/0147664 | A1 | 6/2013 | Lin | |
| 2014/0333489 | A1 | 11/2014 | Konanur et al. | |
| 2015/0249283 | A1* | 9/2015 | Watanabe | H01Q 1/42 343/702 |
| 2015/0311594 | A1 | 10/2015 | Zhu et al. | |
| 2015/0346334 | A1 | 12/2015 | Nagaishi et al. | |
| 2016/0020648 | A1 | 1/2016 | Contopanagos | |
| 2016/0093942 | A1 | 3/2016 | Konanur et al. | |
| 2016/0118713 | A1 | 4/2016 | Hong et al. | |
| 2016/0218417 | A1 | 7/2016 | Konanur et al. | |
| 2016/0308563 | A1* | 10/2016 | Ouyang | H04B 1/04 |
| 2017/0302306 | A1 | 10/2017 | Ouyang et al. | |
| 2018/0026341 | A1 | 1/2018 | Mow et al. | |
| 2019/0020365 | A1 | 1/2019 | Ouyang et al. | |
| 2019/0097301 | A1* | 3/2019 | Wu | H01Q 1/421 |
| 2019/0103653 | A1* | 4/2019 | Jeong | H01L 25/0655 |
| 2019/0103666 | A1* | 4/2019 | Balasubramanian | H01Q 1/2283 |
| 2020/0014095 | A1 | 1/2020 | Mow et al. | |

FOREIGN PATENT DOCUMENTS

| | | |
|---|---|---|
| CN | 205790367 | 12/2016 |
| DE | 20 2017 003830 | 11/2017 |
| JP | 09-139621 | 5/1997 |
| JP | 3212835 | 9/2017 |
| KR | 1020020079036 | 10/2002 |
| WO | WO 2007/107101 | 9/2007 |
| WO | WO 2013/090456 | 6/2013 |
| WO | WO 2014/125716 | 8/2014 |
| WO | WO 2014/208027 | 12/2014 |

OTHER PUBLICATIONS

International Search Report dated Feb. 18, 2019 issued in counterpart application No. PCT/KR2018/013224, 9 pages.
European Search Report dated Apr. 12, 2019 issued in counterpart application No. 18208369.1-1205, 13 pages.
Chinese Office Action dated Jul. 6, 2020 issued in counterpart application No. 201811438154.3, 28 pages.
Chinese Office Action dated Mar. 12, 2021 issued in counterpart application No. 201811438154.3, 26 pages.
EP Summons to Attend Oral Proceedings dated Feb. 19, 2021 issued in counterpart application No. 18208369.1-1205, 12 pages.
Chinese Office Action dated Aug. 11, 2021 issued in counterpart application No. 201811438154.3, 28 pages.

* cited by examiner

ELECTRONIC DEVICE COMPRISING ANTENNA

CROSS-REFERENCE TO RELATED APPLICATION(S)

This application is based on and claims priority under 35 U.S.C. § 119 to Korean Patent Application No. 10-2017-0160536, filed on Nov. 28, 2017, in the Korean Intellectual Property Office, the disclosure of which is incorporated by reference herein in its entirety.

BACKGROUND

1. Field

The present disclosure relates to an antenna transmitting and/or receiving a signal in a millimeter wave (mmWave) band and, more particularly, to an electronic device which increases transmission/reception efficiency of a signal by using a distance between an antenna and a peripheral component.

2. Description of Related Art

A wireless communication system has been developed to support a higher data transfer rate for the purpose of satisfying a traffic demand on wireless data which continue to increase. Nowadays, the $5^{th}$ generation (5G) communication technology which is a next-generation communication technology of the $4^{th}$ generation (4G) communication technology is being researched and developed. The 5G communication technology is targeted for the following: processing of explosive data traffic greater by 1000 times than long term evolution (LTE) being a kind of the 4G communication technology, an epoch-making increase in a transfer rate per user running to an average transfer rate of 1 Gbps, management of connected electronic devices, the number of which is increased dramatically, and low end-to-end latency. The 5G network may make it possible to transmit/receive a signal of a frequency belonging to a high mmWave band compared with the 4G network. For example, the 5G network may make it possible to transmit/receive a signal in a wide frequency band while having a high frequency such as 20 GHz to 100 GHz.

There is required the development of an antenna which may transmit and/or receive a signal of a high frequency and in a wide band for the purpose of supporting a next-generation wireless communication system. Since the antenna may have a significant influence from a peripheral component, such as a dielectric or a metal, in an operation, a technique for preventing reduction of performance due to the peripheral component is being developed.

According to the related art, the gain of the antenna may be increased by adding a metal pattern to the dielectric or deforming the dielectric to a shape of a convex lens, but there occurs the following issue: complexity of process, an increase in costs, reduction of reliability, or an insufficient mounting space. In addition, according to the related art, it is difficult to increase the gain in various directions even though a fixed pattern is used.

SUMMARY

An aspect of the present disclosure is to provide an electronic device which increases transmission/reception efficiency by using a distance between an antenna and a peripheral component.

In accordance with an aspect of the present disclosure, an electronic device is provided. The electronic device includes a housing including a first plate, a second plate facing the first plate and spaced from the first plate, and a side member surrounding a space between the first plate and the second plate, wherein the second plate includes a nonconductive material, at least one antenna element that is positioned within the space and positioned on a substrate parallel to the second plate, wherein the at least one antenna element is spaced from the second plate by a gap h, and a wireless communication circuit electrically connected to the antenna element and configured to transmit and/or receive a signal with a frequency between 20 GHz and 100 GHz and a wavelength corresponding to the frequency, wherein the gap h corresponds to $$\frac{n\lambda}{2},$$

wherein n is an integer and λ is the wavelength.

In accordance with another aspect of the present disclosure, an electronic device is provided. The electronic device includes a housing including a first plate, a second plate facing the first plate and spaced from the first plate, and a side member surrounding a space between the first plate and the second plate, wherein the second plate includes a nonconductive material, at least one antenna element that is positioned within the space and positioned on a substrate parallel to the second plate, wherein the at least one antenna element faces the second plate and is spaced from the second plate by a gap h, a wireless communication circuit electrically connected to the antenna element and configured to transmit and/or receives a signal with a frequency between 20 GHz and 100 GHz and a first wavelength, and a dielectric material positioned the gap h between the antenna element and the second plate and allowing the signal to change to a second wavelength less than the first wavelength, wherein the second wavelength is defined as $$\lambda_2 = \frac{c}{f\sqrt{\varepsilon\mu}},$$

wherein f is a frequency of the signal, c is a speed of light constant 3×10^8 meters/second), ε is a permittivity of the dielectric material, μ is a permeability of the dielectric material, and the gap h corresponds to $$\frac{n\lambda_2}{2},$$

wherein n is an integer.

In accordance with another aspect of the present disclosure, an electronic device is provided. The electronic device includes a housing including a first plate, a second plate facing the first plate and spaced from the first plate, and a side member surrounding a space between the first plate and the second plate, wherein the second plate includes a nonconductive material, at least one antenna element positioned within the space and positioned on a substrate parallel to the second plate, wherein the at least one antenna element faces the second plate and is spaced from the second plate by a gap, a dielectric material positioned in the gap between the antenna element and the second plate, and a wireless communication circuit electrically connected to the antenna element and configured to transmit and/or receives a signal with a frequency between 20 GHz and 100 GHz.

BRIEF DESCRIPTION OF THE DRAWINGS

The above and other aspects, features, and advantages of certain embodiments of the present disclosure will be more apparent from the following description, taken in conjunction with the accompanying drawings, in which.

DETAILED DESCRIPTION

Hereinafter, various embodiments of the present disclosure may be described with reference to accompanying drawings. Accordingly, those of ordinary skill in the art will recognize that modification, equivalent, and/or alternative on the various embodiments described herein can be variously made without departing from the scope and spirit of the present disclosure.

Figure 1:
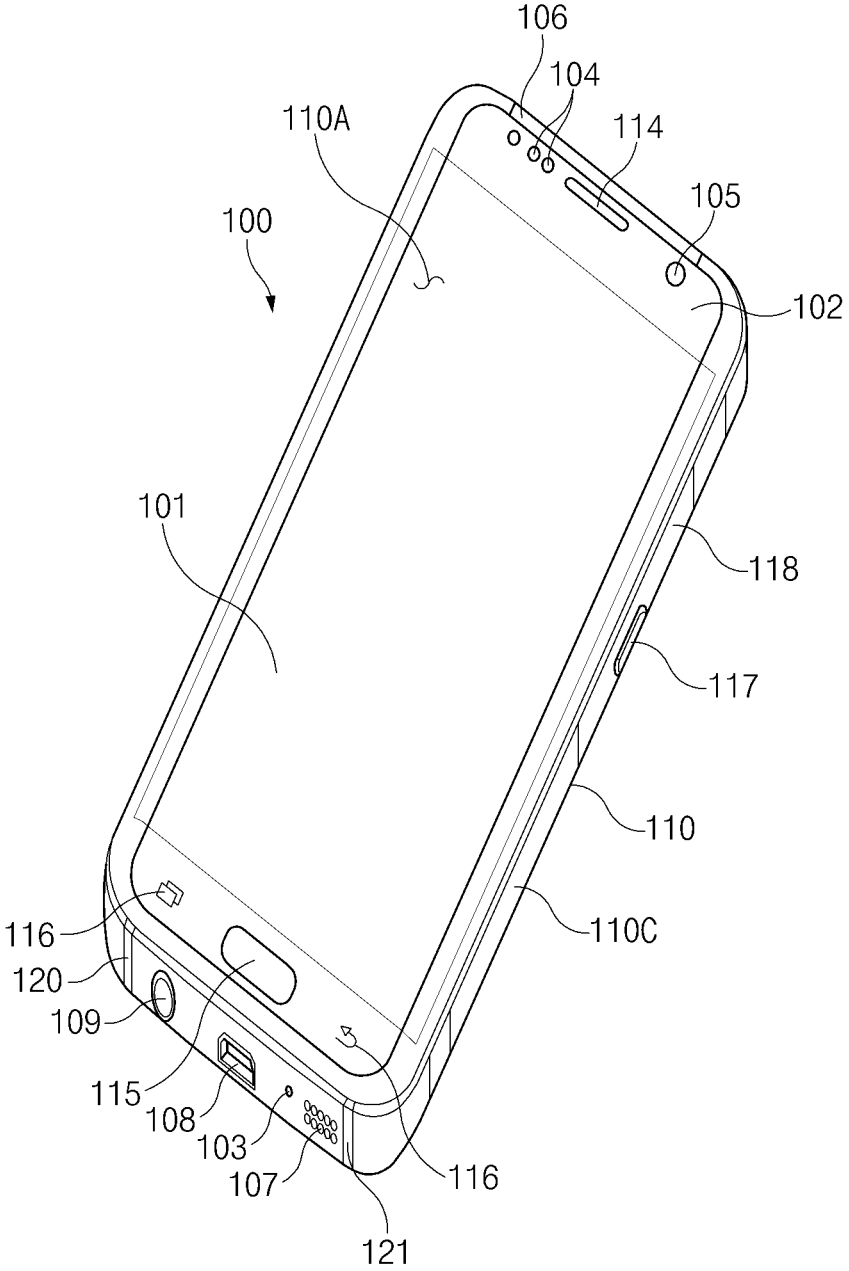
FIG. 1 is a front perspective view of an electronic device according to an embodiment.

FIG. 1 is a front perspective view of an electronic device 100 according to an embodiment.

Figure 2:
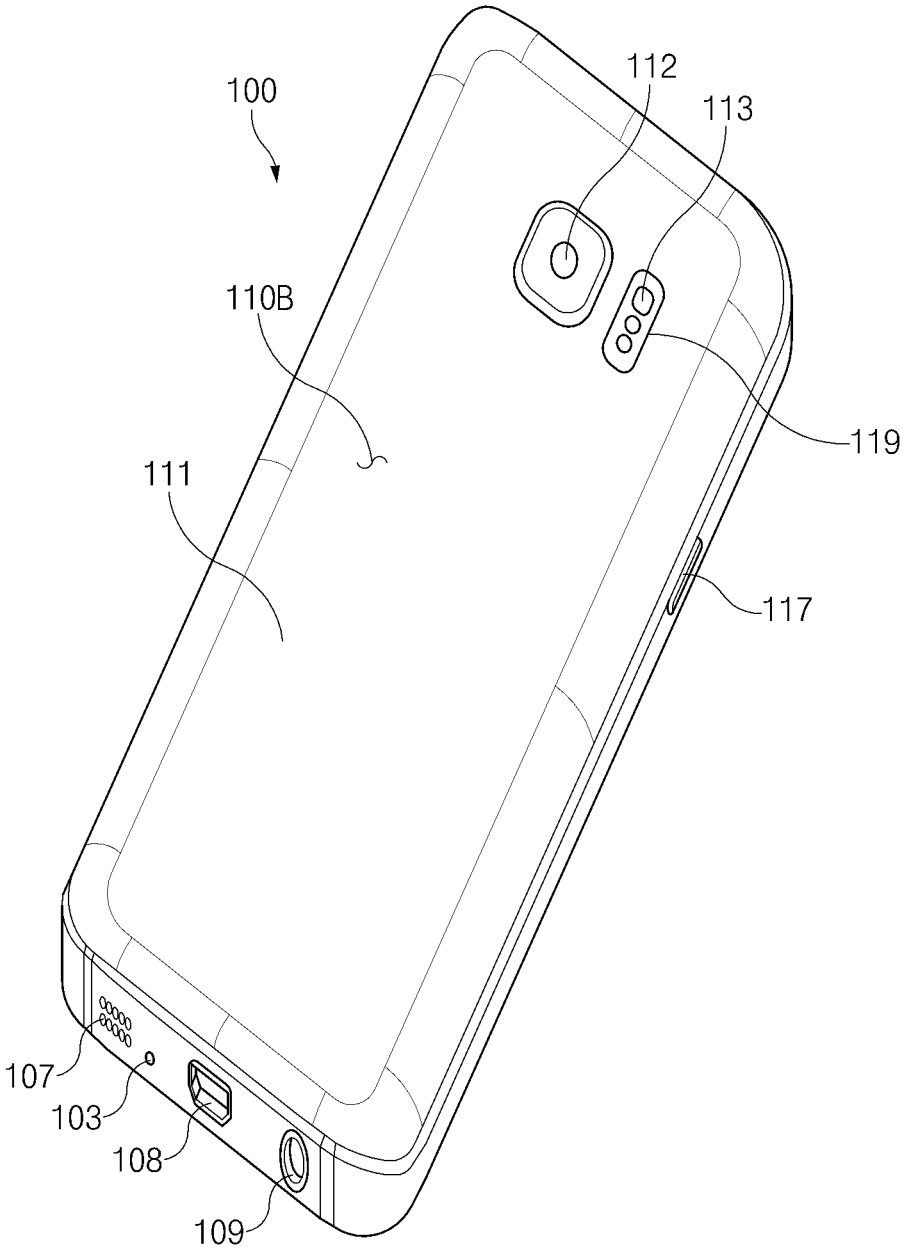
FIG. 2 is a back perspective view of the electronic device of FIG. 1.

FIG. 2 is a back perspective view of the electronic device 100 of FIG. 1.

Referring to FIGS. 1 and 2, the electronic device 100 according to an embodiment may include a housing 110 including a first surface (or a front surface) 110A, a second surface (or a back surface) 110B, and a side surface 110C surrounding a space between the first surface 110A and the second surface 110B. In another embodiment, a housing may refer to a structure which forms a portion of the first surface 110A, the second surface 110B, and the side surface 110C of FIGS. 1 and 2.

According to an embodiment, the first surface 110A may be formed by a first plate (or a front plate) 102 (e.g., a glass plate including various coating layers, or a polymer plate), at least a portion of which is substantially transparent.

The second surface 110B may be formed by a second plate (or a back plate) 111. The second plate 111 may be formed by coated or colored glass, ceramic, polymer, metal (e.g., aluminum, stainless steel (STS), or magnesium), or a combination of at least two of the materials.

The side surface 110C may be coupled with the first plate 102 and the second plate 111, and may be formed by a side bezel structure (or a side member) 118 including metal and/or polymer. The side member 118 may include at least one nonconductive material 120 or 121 for the purpose of transmitting and/or receiving a signal. The second plate 111 and the side bezel structure 118 may be integrally formed and may include the same material (e.g., a metal material such as aluminum).

The electronic device 100 may include at least one or more of a display 101, an audio module (103, 107, 114), a sensor module (104, 119), a camera module (105, 112, 113), a key input device (115, 116, 117), an indicator 106, and a connector hole (108, 109). The electronic device 100 might not include at least one (e.g., the key input device (115, 116, 117) or the indicator 106) of the components or may further include another component.

The display 101 may be exposed through a considerable portion of the first plate 102, for example. The display 101 may be coupled with a touch sensing circuit, a pressure sensor which may measure an intensity (or pressure) of a touch, and/or a digitizer detecting a magnetic stylus pen, or may be positioned adjacent thereto.

The audio module (103, 107, 114) may include a microphone hole 103 and a speaker hole (107, 114). A microphone for obtaining external sound may be positioned within the microphone hole 103. A plurality of microphones may be positioned to make it possible to detect a direction of sound. The speaker hole (107, 114) may include an external speaker hole 107 and a receiver hole 114 for a call. The speaker hole (107, 114) and the microphone hole 103 may be implemented with one hole, or a speaker (e.g., a piezo speaker) may be included without the speaker hole (107, 114).

The sensor module (104, 119) may generate an electrical signal or a data value which corresponds to an internal operating state of the electronic device 100 or an external environment state. The sensor module (104, 119) may include, for example, a first sensor module 104 (e.g., a proximity sensor) and/or a second sensor module (e.g., a fingerprint sensor) positioned on the first surface 110A of the housing 110, and/or a third sensor module 119 (e.g., a heart rate monitor (HRM) sensor) positioned on the second surface 110B of the housing 110.

The fingerprint sensor may be positioned on the second surface 110B as well as the first surface 110A (e.g., a home key button 115) of the housing 110. The electronic device 100 may further include a sensor module, for example, at least one of a gesture sensor, a grip sensor, a barometric pressure sensor, a magnetic sensor, an acceleration sensor, a grip sensor, a color sensor, an infrared (IR) sensor, a biometric sensor, a temperature sensor, a humidity sensor, or an illumination sensor 104.

The camera module (105, 112, 113) may include a first camera device 105 positioned on the first surface 110A of the electronic device 100, and a second camera module 112 and/or a flash 113 positioned on the second surface 110B. The camera modules 105 and 112 may include one or more lenses, an image sensor, and/or an image signal processor. The flash 113 may include, for example, a light emitting diode (LED) or a xenon lamp. Two or more lenses (wide-angle and telephoto lenses) and image sensors may be positioned on one surface of the electronic device 100.

The key input device (115, 116, 117) may include the home key button 115 positioned on the first surface 110A of the housing 110, a touch pad(s) 116 positioned in the vicinity of the home key button 115, and/or a side key button 117 positioned on the side surface 110C of the housing 110. The electronic device 100 may not include all or a part of the key input devices 115, 116, 117, and the key input device(s) not included may be implemented on the display 101 in the form of a soft key.

The indicator 106 may be positioned, for example, on the first surface 110A of the housing 110. The indicator 106 may provide state information of the electronic device 100, for example, in the form of light, and may include an LED.

The connector hole (108, 109) may include a first connector hole 108 which may accommodate a connector (e.g., a universal serial bus (USB) connector) for transmitting/receiving a power and/or data to/from an external electronic device, and/or a second connector hole (or an earphone jack) 109 which may accommodate a connector for transmitting/receiving an audio signal to/from the external electronic device.

Figure 3:
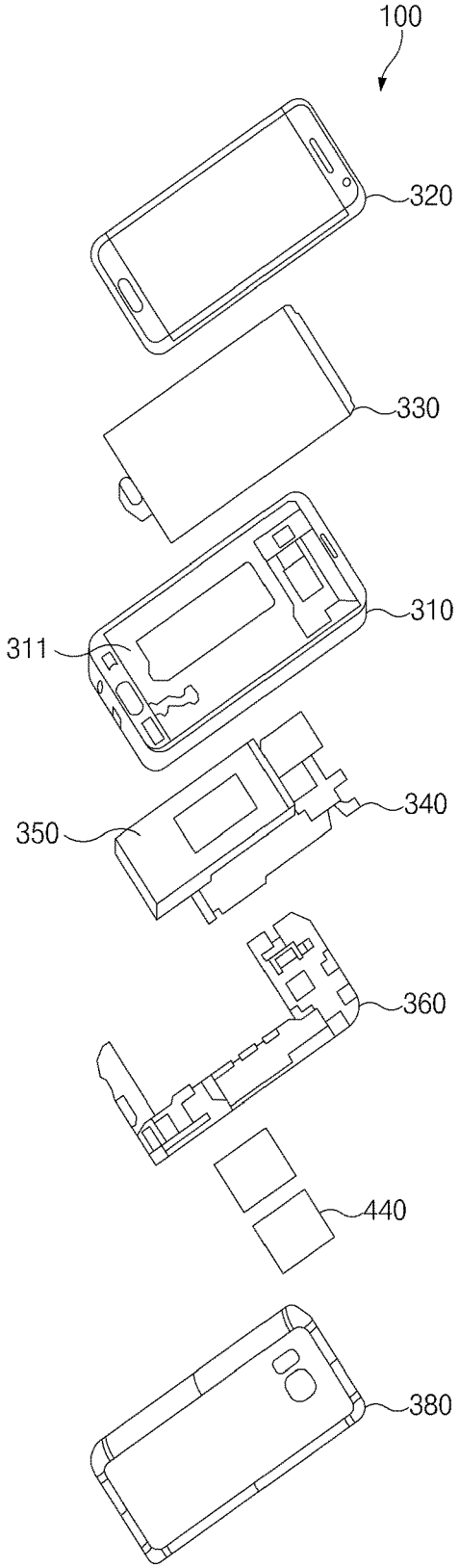
FIG. 3 is an exploded perspective view of the electronic device of FIG. 1.

FIG. 3 is an exploded perspective view of the electronic device 100 of FIG. 1, according to an embodiment.

Referring to FIG. 3, the electronic device 100 may include a side bezel structure 310, a first support member 311 (e.g., a bracket), a first plate 320, a display 330, a substrate 340, a battery 350, a second support member 360 (e.g., a rear case), a communication device 440, and a second plate 380. In any embodiment, the electronic device 100 might not include at least one (e.g., the first support member 311 or the second support member 360) of the components or may further include another component. At least one of the components of the electronic device 100 may be identical or similar to at least one of the components of the electronic device 100 of FIG. 1 or 2, and thus, additional description is omitted to avoid redundancy.

The first support member 311 may be positioned within the electronic device 100, and may be connected with the side bezel structure 310 or may be integrally formed with the side bezel structure 310. The first support member 311 may be formed of, for example, a metal material and/or a nonmetal material (e.g., polymer). The display 330 may be coupled with one surface of the first support member 311, and the substrate 340 may be coupled with an opposite surface of the first support member 311. A processor, a memory, and/or an interface may be mounted on the substrate 340. According to an embodiment, the substrate 340 which is a printed circuit board (PCB) may be a main PCB. For example, the processor may include one or more of a central processing unit, an application processor, a graphic processing device, an image signal processor, a sensor hub processor, or a communication processor.

The memory may include, for example, a volatile memory or a nonvolatile memory.

The interface may include, for example, a high definition multimedia interface (HDMI), a USB interface, a secure digital (SD) card interface, and/or an audio interface. The interface may electrically or physically connect, for example, the electronic device 100 with an external electronic device and may include a USB connector, an SD card/multimedia card (MMC) connector, or an audio connector.

The battery 350 which is a device for supplying power to at least one component of the electronic device 100 may include, for example, a primary cell incapable of being recharged, a rechargeable secondary cell, or a fuel cell. At least a portion of the battery 350 may be positioned on substantially the same plane as the printed circuit board 340, for example. The battery 350 may be integrally positioned within the electronic device 100, and may be positioned removable from the electronic device 100.

The communication device 440 may be interposed between the second plate 380 and the battery 350. The communication device 440 may be an mmWave module. The communication device 440 may transmit and/or receive a signal in an mmWave band, and may process a transmit signal or a receive signal. The electronic device 100 may include at least one communication device 440. The electronic device 100 may include a plurality of mmWave modules 440. The mmWave band may include a frequency band ranging from 20 GHz to 100 GHz. The communication device 440 may include a plurality of antenna elements for transmitting and/or receiving a signal in the mmWave band.

Figure 4A:
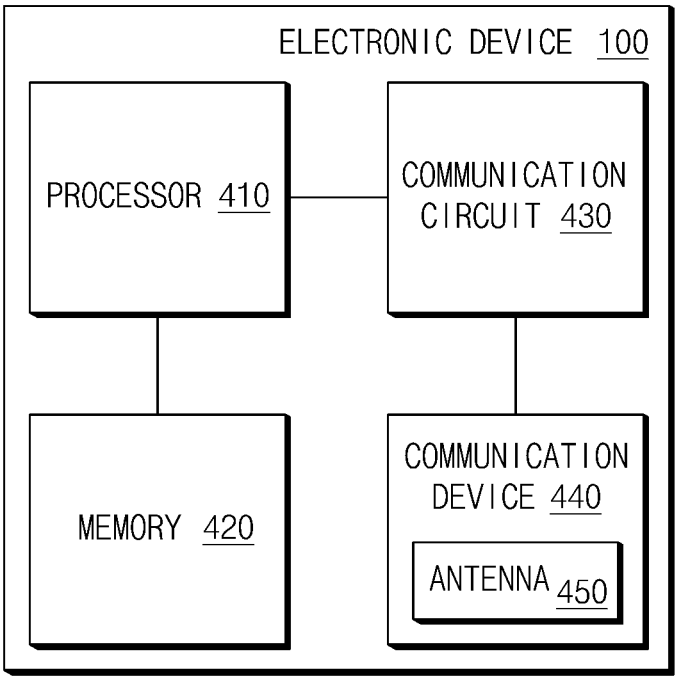
FIG. 4A is a block diagram of an electronic device according to an embodiment.
Figure 4B:
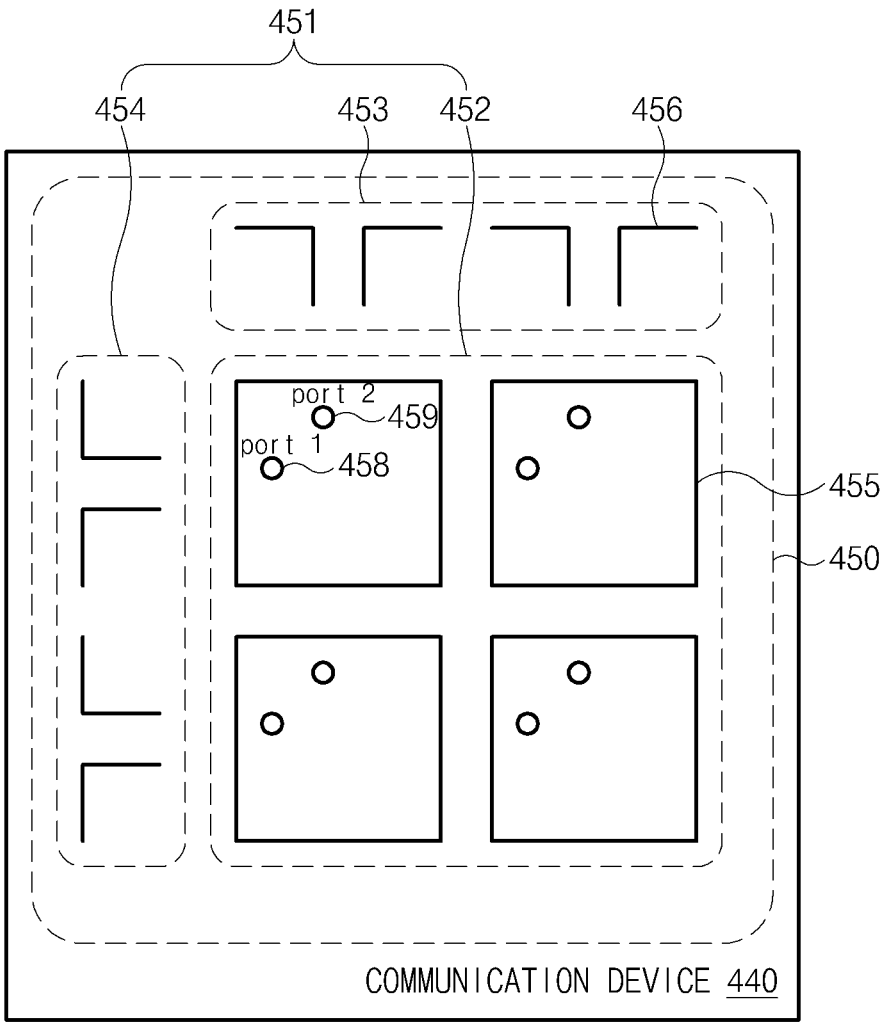
FIG. 4B is an illustration of a communication device according to an embodiment.
Figure 4C:
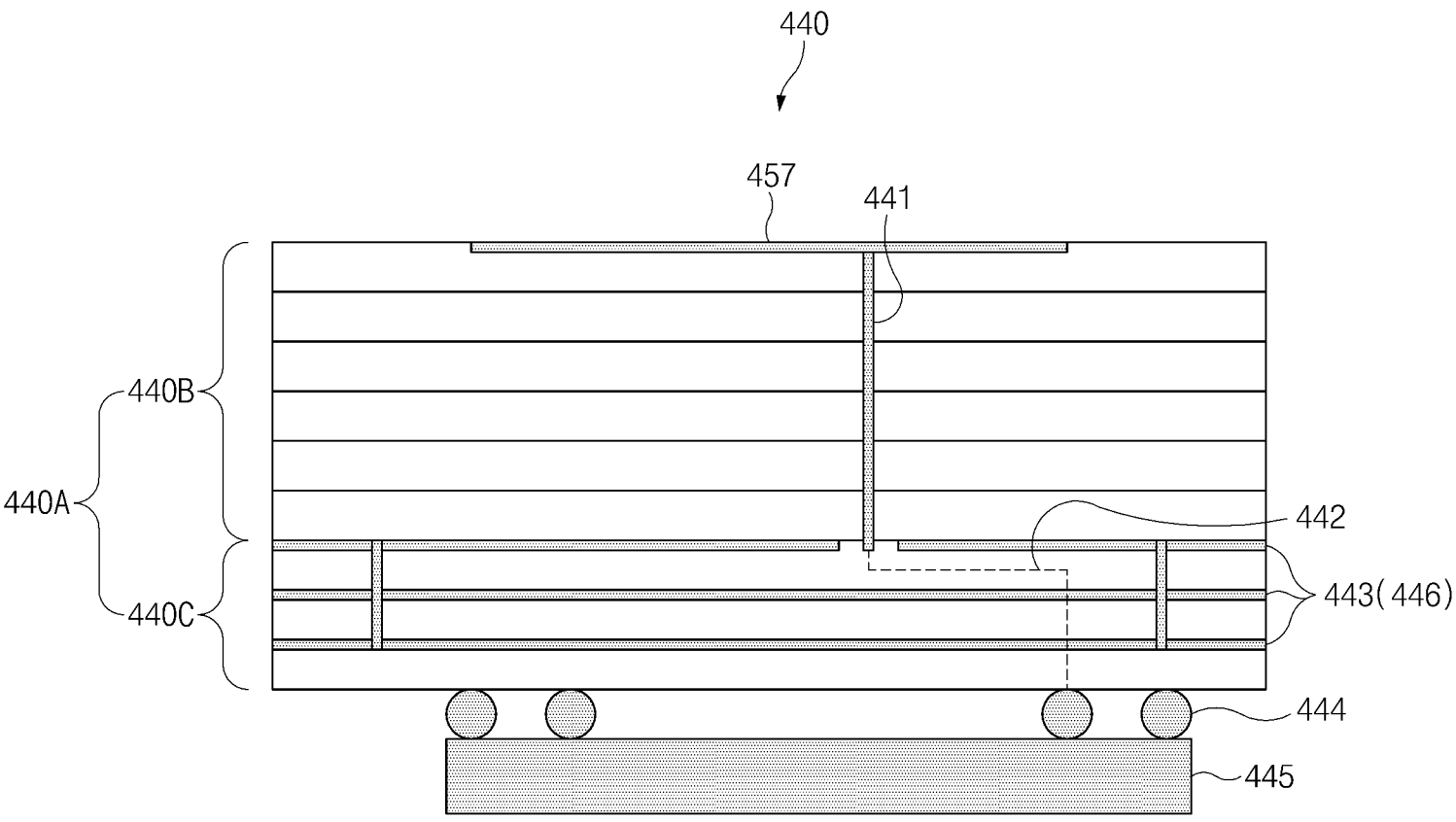
FIG. 4C is a sectional view of a communication device according to an embodiment.
Figure 4D:
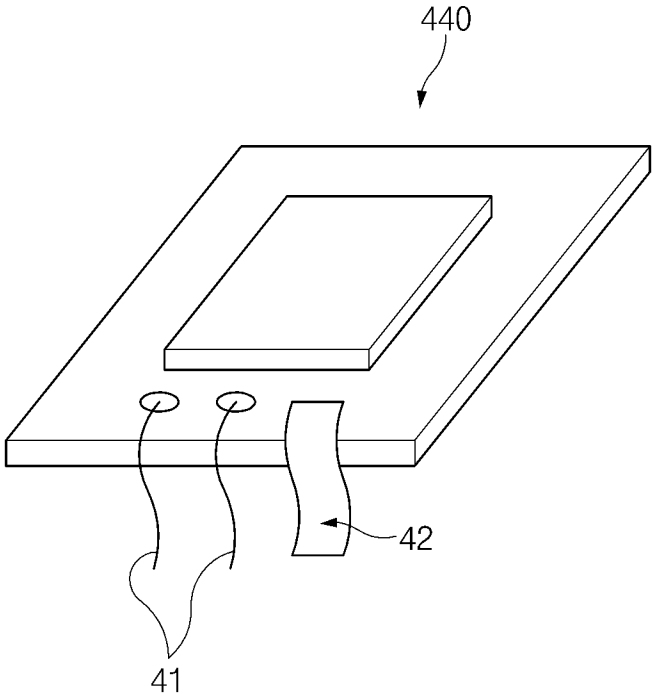
FIGS. 4DA and 4DB is a view illustrating a front surface and a back surface of a communication device according to an embodiment.
Figure 4D:
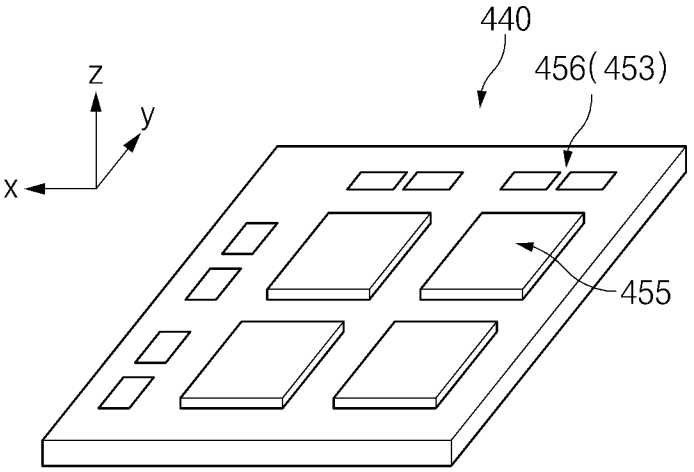

FIG. 4A is a block diagram of an electronic device, and FIGS. 4B to 4D are illustrations of a communication device, according to an embodiment.

Referring to FIG. 4A, the electronic device 100 may include a processor 410, a memory 420, a communication circuit 430, or a communication device 440. The electronic device 100 illustrated in FIG. 4A is merely an example, and various modification which may implement various embodiments of the present disclosure is possible. For example, the electronic device 100 may include a configuration of an electronic device 2001 illustrated in FIG. 20, or may be appropriately changed or modified by using the configurations.

The processor 410 may execute instructions stored in the memory 420; the processor 410 may perform an operation according to various embodiments of the present disclosure or may control any other components for the purpose of performing the operation. The processor 410 may perform wired or wireless communication with an external device through the communication circuit 430. The processor 410 may include an application processor and/or a communication processor.

The memory 420 may store instructions which cause the processor 410 to perform an operation according to an embodiment of the present disclosure. In addition, the memory 420 may store a variety of information according to an embodiment of the present disclosure.

The communication circuit 430 may communicate with an external device over a network. For example, the communication circuit 430 may perform communication with a network by using wired communication or wireless communication. The communication circuit 430 may be included in a communication module 2090 of FIG. 20.

The wireless communication may comply with a cellular communication protocol. For example, the cellular communication protocol may include a communication protocol which supports transmitting and/or receiving a signal in the mmWave band (e.g., a frequency band ranging from 20 GHz to 100 GHz). To this end, the communication circuit 430 may include a cellular module (e.g., a 5G modem) for transmitting and/or receiving a signal in the mmWave band.

The communication circuit 430 may be electrically connected to the communication device 440. The communication circuit 430 may be configured to transmit and/or receive a signal in the mmWave band through an antenna 450 connected to the communication device 440.

The communication device 440 may process a signal in the mmWave band. For example, the communication device 440 may be an mmWave module. The communication device 440 may convert a signal in a baseband or an inter-frequency ((IF) signal) band (not greater than 20 GHz) to a signal in the mmWave band, or may convert a signal in the mmWave band to a signal in the baseband or the inter-frequency (IF signal) band (not greater than 20 GHz). The mmWave band may include at least a portion of a frequency band ranging from 20 GHz to 100 GHz. The communication device 440 may be included in a wireless communication module 2092 of FIG. 20.

The communication device 440 may be implemented to include the antenna 450 which may transmit and/or receive a signal in the mmWave band.

The antenna 450 may be referred to as an antenna module. The antenna 450 may include at least one array antenna including a plurality of antenna elements for beamforming. The at least one array antenna may include a plurality of antenna elements, and the plurality of antenna elements may be implemented in various arrays such as 1×4, 2×2, 3×3, 2×3, or the like. The at least one array antenna may be implemented with an antenna module having an array. The at least one array antenna may be electrically connected to the communication circuit 430.

Below, an embodiment is described where the communication device 440 includes the antenna 450, but this is not intended to limit the implementation of the communication device 440. The communication device 440 might not include the antenna 450.

FIG. 4B is an illustration of the communication device 440 according to an embodiment.

Referring to FIG. 4B, the communication device 440 may include the antenna 450, and the antenna 450 may include at least one array antenna 451.

The at least one array antenna 451 may include a plurality of antenna elements 455 and a plurality of antenna elements 456, and may be implemented in such a way that a plurality of antenna elements have an array.

The at least one array antenna 451 may include at least one of a patch array antenna 452 or a dipole array antenna (453, 454).

The patch array antenna 452 may include a plurality of patch antennas 455, and the plurality of patch antennas 455 may be placed in the patch array antenna 452 with an array. A case where the plurality of patch antennas 455 have a 2×2 array is shown in FIG. 4B. In addition, the plurality of patch antennas 455 may be arranged in various forms (e.g., a 1×2 array, a 1×4 array, or the like).

The patch antenna 455 may include a feeding part (a first port 458 and a second port 459) for electrical connection with the communication circuit 430 (or a radio frequency (RF) circuit (e.g., an RF integrated circuit (RFIC))). The feeding part may include a connection point connecting the patch antenna 455 and the communication circuit 430.

According to an embodiment, the dipole array antenna (453, 454) may include a plurality of dipole antennas 456, and the plurality of dipole antennas 456 may be placed in the dipole array antenna (453, 454) with an array. A case where the plurality of dipole antennas 456 have a 1×2 array is shown in FIG. 4B. In addition, the plurality of dipole antennas 456 may be arranged in various forms.

The dipole antenna 456 may have plus (+) and minus (−) polarities. The (+) polarity may be a feeding part for electrically connecting the communication circuit 430 and the dipole antenna 456, like the port 1 458 of the patch antenna 455. The dipole antenna 456 may be connected to the communication circuit 430 through the (+) polarity. The feeding part may include a connection point connecting the dipole antenna 456 and the communication circuit 430.

FIG. 4C is a sectional view of a communication device 440, according to an embodiment.

Referring to FIG. 4C, a portion 440A of the communication device 440 is shown. According to an embodiment, the communication device 440 may include an antenna region 440B where an antenna element 457 is positioned, and a communication region 440C including an RF circuit 445 (e.g., an RFIC) and components connecting the antenna element 457 and the RF circuit 445, when viewing the portion 440A. At least a portion of the communication device 440 may be implemented in the form of a substrate such as a PCB. For example, the antenna region 440B and/or the communication region 440C may be implemented with a substrate (e.g., a PCB), and the antenna element 457 may be positioned in the antenna region 440B of the substrate. Below, the substrate implementing the communication device 440 may be referred to as a PCB for distinction from the substrate 340 of FIG. 1.

The antenna region 440B may include the antenna element 457 and at least a portion of a feeding part 441.

According to an embodiment, the antenna element 457 may be a patch antenna 455 or a dipole antenna 456. For example, the antenna element 457 may be an antenna element of a patch form in which one side has a length of half the wavelength.

The antenna element 457 may be electrically connected to the RF circuit 445 through the feeding part 441. The feeding part 441 may be positioned on the PCB. The feeding part 441 may be a via.

The communication region 440C may include an internal wiring 442, at least one ground layer 443, or the RF circuit 445.

The internal wiring 442 may connect the RF circuit 445 with the feeding part 441.

The communication region 440C may include at least one or more ground layers 443. The ground layers 443 may be electrically connected to each other. For example, the ground layers 443 may be connected through a via. The ground layer 443 may be formed of a conductive layer 446.

The RF circuit 445 may transmit an RF signal to the antenna element 457 or may obtain an RF signal through the antenna element 457. The RF circuit 445 may include a power amplifier, a phase shifter (PS), and/or a low noise amplifier (LNA) for the purpose of processing the RF signal. The RF circuit 445 may transmit and/or receive a signal to and/or from the antenna element 457 through the internal wiring 442 and the feeding part 441.

The RF circuit 445 and the internal wiring 442 may be connected through a connection member 444. The connection member 444 may have a ball shape and may be formed in a soldering manner.

The communication device 440 and an array antenna may be formed by connecting the portion 440A with any other portion.

FIGS. 4DA and 4DB are illustrations of a front surface and a back surface of a communication device, respectively, according to an embodiment.

Referring to FIGS. 4DA and 4DB, a front surface of the communication device 440 may be positioned toward a first direction (e.g., a +z direction). The first direction may be a direction which is opposite to a direction facing a second plate 380 or a side member (e.g., 118). The plurality of antenna elements 455 and 456 (or the array antenna 453) may be positioned on the front surface. One array antenna may be implemented by arraying a plurality of antenna elements 457.

A patch array antenna may be implemented by placing the patch antennas 455 with an array of 1×2, 2×1, 2×2, or the like. The patch array antenna may be an antenna for forming a beam in the first direction (e.g., a +z direction).

A dipole array antenna may be implemented by placing the dipole antennas 456 with an array of 1×2, 2×1, or the like. The dipole array antenna may be an antenna for forming a beam in a second direction (e.g., a +x or a +y direction) perpendicular to the first direction.

A back surface which is positioned to face a third direction (e.g., a −z direction) being an opposite direction to the front surface may be in contact with a support member 360. The back surface may be connected to an external wiring 41 for connection between a communication circuit 430 and the communication device 440. The external wiring 41 may be exposed outside a substrate 340. The external wiring 41 may be formed of a coaxial cable. The back surface may include the communication device 440 and a connection line 42 connected to the substrate. The connection line 42 may be a power and control line. According to an embodiment, the connection line 42 may be implemented with a flexible PCB (FPCB). The connection line 42 may be electrically connected to a processor 410 or a communication circuit.

Figure 5A:
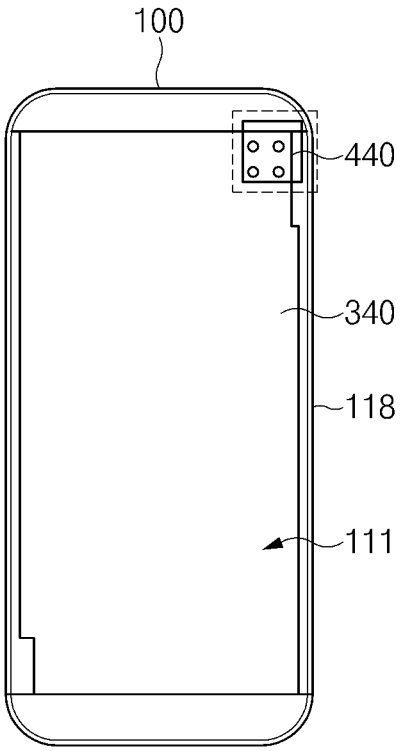
FIG. 5A is an illustration of a structure in which a communication device is positioned, according to an embodiment.
Figure 5B:
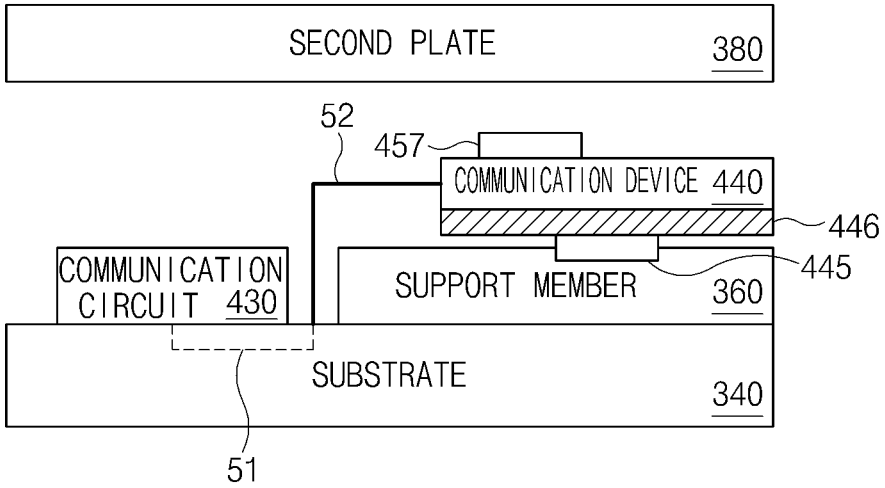
FIG. 5B is an illustration of a hierarchical structure in which a communication device is positioned, according to an embodiment.

FIGS. 5A and 5B are illustrations of a structure in which a communication device 440 is positioned at an electronic device 100, according to an embodiment.

Referring to FIG. 5A, the communication device 440 may be positioned on the substrate 340 of the electronic device 100. For example, the communication device 440 may be interposed between the substrate 340 and the second plate 111 or the second plate 380.

The communication device 440 may be positioned parallel to the second plate 111, and may be positioned to face the second plate 111. In this case, the communication device 440 may transmit or receive a signal through the second plate 111, or may transmit or receive a signal through the side member 118.

The communication device 440 may be positioned in consideration of any other configurations on the substrate 340 or efficiency to transmit/receive a signal. For example, the communication device 440 may be positioned at an edge of the substrate 340 so as to be adjacent to the side member 118. The case where the communication device 440 is adjacent to the side member 118 on an upper end portion of the electronic device 100 is shown, but a location of the communication device 440 may be variously changed. For example, the communication device 440 may be positioned adjacent to the side member 118 on a lower end portion of the electronic device 100.

The electronic device 100 may include a plurality of communication devices 440. The plurality of communication devices 440 may be positioned on the substrate 340 to be spaced from each other for the purpose of reducing mutual influence upon positioning the plurality of communication devices 440. For example, as illustrated in FIG. 5A, when viewing the substrate 340 from above the second plate 111, the communication device 440 may be positioned adjacent to a vertex of the substrate 340.

FIG. 5B is an illustration of a hierarchical structure of an electronic device including a communication device, according to an embodiment.

The communication device 440 may be interposed between the second plate 380 and the support member 360, and the at least one antenna element 457 may be positioned on one surface of the communication device 440 so as to face the second plate 380.

The substrate 340 may be positioned on another surface of the support member 360, which is opposite to the one surface on which the communication device 440 is positioned. The support member 360 and the communication circuit 430 may be positioned on the substrate 340. The support member 360 may fix the communication device 440, the communication circuit 430, and the substrate 340. The support member 360 may be formed of a plastic material, a metal material, and/or a steel use stainless (SUS) material. The support member 360 may be provided in a form which may fix or support the substrate 340 and the communication device 440. The support member 360 is illustrated in FIG. 5B as being in a quadrangular form, but the support member 360 may have various forms without limitation thereto.

The communication device 440 and the communication circuit 430 may exchange signals with each other. The communication circuit 430 may transmit and/or receive a signal to and/or the communication device 440 through an internal wiring 51 positioned inside the substrate 340 and/or an external wiring 52 positioned outside the substrate 340. For example, the communication circuit 430 may transmit and/or receive a signal to and/or from the RF circuit 445. According to an embodiment, the external wiring 52 may include a coaxial cable.

The at least one antenna element 457 may be positioned on the communication device 440 so as to face the second plate 380. One array antenna may be implemented by arraying a plurality of antenna elements 457.

The conductive layer 446 (or the ground layer 443) may be positioned within the communication device 440, and the RF circuit 445 may be interposed between the communication device 440 and the support member 360 or may be positioned within the communication device 440. The RF circuit 445 may supply a signal to the at least one antenna element 457 or may provide a signal obtained from the at least one antenna element 457 to the communication circuit 430.

The at least one antenna element 457 may transmit and/or receive a signal through the second plate 380 or a side member 118. The at least one antenna element 457 may constitute an antenna module (e.g., the antenna 450).

Figure 6A:
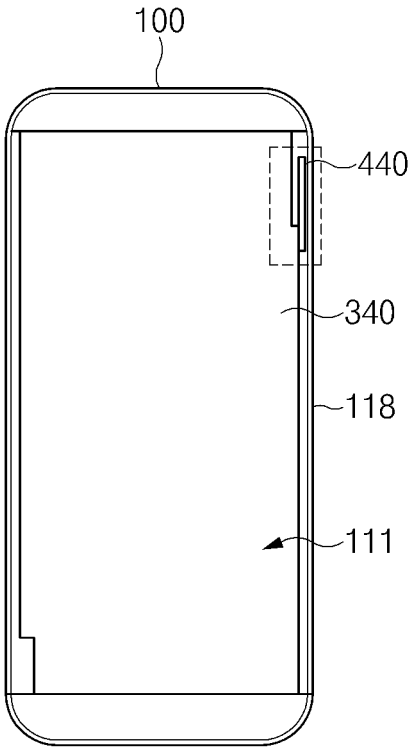
FIGS. 6AA and 6AB are illustrations of a structure in which a communication device is positioned, according to an embodiment.
Figure 6A:
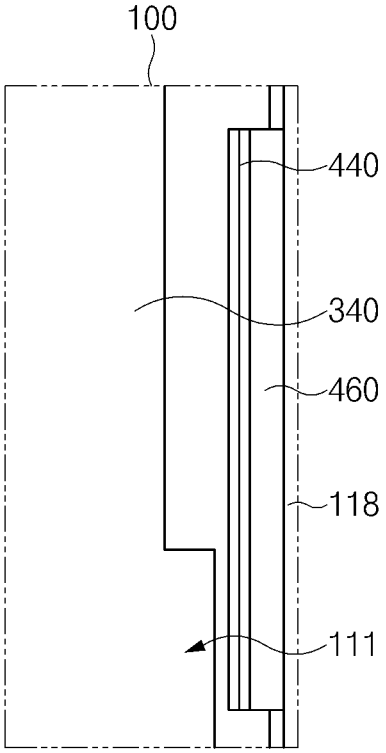

FIGS. 6AA, 6AB, and 6B are illustrations of a structure in which a communication device is positioned, according to an embodiment.

Referring to FIGS. 6AA and 6AB, the communication device 440 may be positioned on the substrate 340 of the electronic device 100. For example, the communication device 440 may be interposed between the substrate 340 and the side member 118.

The communication device 440 may be positioned parallel to the side member 118, and may be positioned to face the side member 118. In this case, the communication device 440 may transmit or receive a signal through the second plate 111 or 380, or may transmit or receive a signal through the side member 118.

The communication device 440 may be interposed between the substrate 340 and the side member 118, and the communication device 440 may be positioned to be spaced from other components of the substrate 340. For example, as illustrated in FIG. 6AB, when viewing the substrate 340 from above the second plate 111, the communication device 440 may be positioned adjacent to a vertex of the substrate 340.

The electronic device 100 may include a dielectric layer 460 interposed between the communication device 440 and the side member 118. As described below, the dielectric layer 460 may be positioned to transmit or receive a signal efficiently, depending on a gap (or a distance) between the communication device 440 and the side member 118.

Figure 6B:
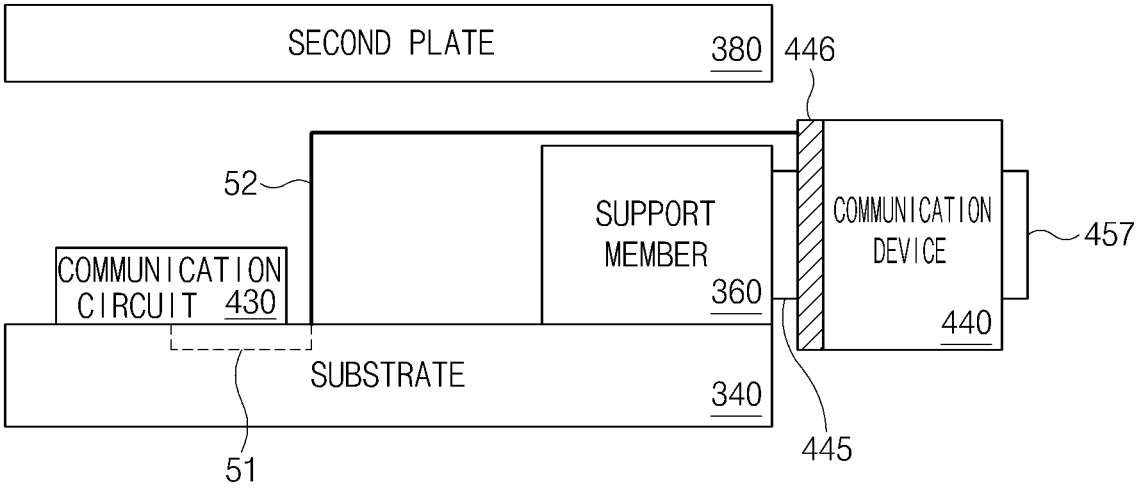
FIG. 6B is an illustration of a hierarchical structure in which a communication device is positioned, according to an embodiment.

FIG. 6B is an illustration of a hierarchical structure of an electronic device including a communication device, according to an embodiment.

Referring to FIG. 6B, the second plate 380, the communication circuit 430, the substrate 340, the support member 360, the RF circuit 445, or the conductive layer 446 of FIG. 6B are identical or similar to the respective components of FIG. 5B, and thus, additional description is omitted to avoid redundancy.

The communication device 440 may be interposed between the side member 118 and the support member 360, and the at least one antenna element 457 may be positioned on one surface of the communication device 440 so as to face the side member 118. The at least one antenna element 457 may radiate or receive a signal through the second plate 380 or the side member 118.

The conductive layer 446 or the ground layer 443 may be positioned within the communication device 440, and the RF circuit 445 may be interposed between the communication device 440 and the support member 360 or may be positioned within the communication device 440. The RF circuit 445 may supply a signal to the at least one antenna element 457 or may provide a signal obtained from the at least one antenna element 457 to the communication circuit 430.

Figure 7:
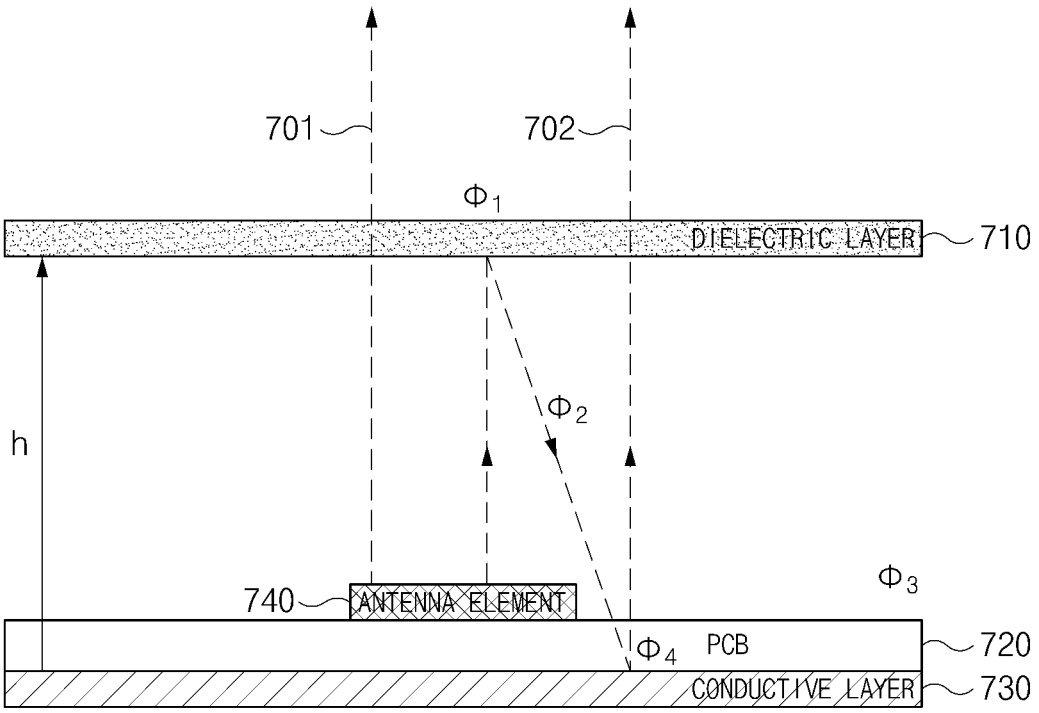
FIG. 7 is an illustration of a structure in which an antenna is positioned within an electronic device, according to an embodiment.

FIG. 7 is an illustration of a structure in which an antenna is positioned within an electronic device, according to an embodiment.

Referring to FIG. 7, an antenna element 740 may be interposed between a dielectric layer 710 (e.g., the second plate 380 or the side member 118) and a conductive layer 730. The conductive layer 730 may be positioned on a PCB 720 to be opposite to the antenna element 740. The antenna element 740 may be positioned on one surface of the PCB 720, and the conductive layer 730 may be positioned on an opposite surface of the PCB 720. The antenna element 740 is illustrated in FIG. 7 in the form of a patch antenna, but the antenna element 740 may be a dipole antenna. A feeding part 441 may be connected to the antenna element 740.

The antenna element 740 may radiate a signal toward the dielectric layer 710. In this case, a portion of the signal radiated by the antenna element 740 may penetrate the dielectric layer 710, and at least a portion of the rest of the signal may be reflected by the dielectric layer 710. The signal reflected from the dielectric layer 710 may be reflected by the conductive layer 730.

A signal penetrating the dielectric layer 710 may be referred to as a transmitted wave, and a signal reflected from the dielectric layer 710 may be referred to as a reflected wave. A signal reflected once from the dielectric layer 710 may be expressed as a first order reflected wave, and a signal reflected N times may be expressed as an N-th order reflected wave. For convenience of description, below, the first order reflected wave may be exemplified.

Below, a path of the transmitted wave may be referred to as a first path 701, and a path of the reflected wave may be referred to as a second path 702. According to an embodiment, the first path 701 may include a path from the antenna element 740 to the dielectric layer 710, and the second path 702 may include the following paths: a radiation path from the antenna element 740 to the dielectric layer 710, a first reflection path from the dielectric layer 710 to the conductive layer 730, and a second reflection path from the conductive layer 730 to the dielectric layer 710.

Compared with the transmitted wave, a phase delay $\Phi_1$ due to the dielectric layer 710, a phase delay $\Phi_2$ due to a reflection path, a phase delay $\Phi_3$ due to a substrate 720, or a phase delay $\Phi_4$ due to the conductive layer 730 may occur in the reflected wave. A phase of the second path 702 may include the whole phase delay $\Delta$ corresponding to the following Equation (1) with respect to the first path 701.

$$\angle\text{first path}-\angle\text{second path}=\Delta=\Phi_1+2\Phi_2+\Phi_3+\Phi_4 \quad (1)$$

In a case where the whole phase delay is $(2n)\pi$ (with n being an integer), a phase of the transmitted wave may be matched with a phase of the reflected wave, and constructive interference may occur; in a case where the whole phase delay is $180(2n-1)$ (with n being an integer), a phase of the transmitted wave may be opposite to a phase of the reflected wave, and deconstructive interference may occur.

For the constructive interference to occur, a separation distance h between the dielectric layer 710 and the antenna element 740 may satisfy the following Equation (2).

$$\angle\text{first path}-\angle\text{second path}=2n\pi \quad (\text{with } n=0,\pm1,\pm2,\ldots) \quad (2)$$

In an example where $\Phi_1$, $\Phi_3$, or $\Phi_4$ has a constant value (e.g., $\Phi_3=180°$) regardless of a distance between the antenna element 740 and the dielectric layer 710, a gap (hereinafter referred to as a separation distance h) between the dielectric layer 710 and the antenna element 740 may be set to satisfy the following Equation (3) depending on the phase delay $\Phi_2$ due to a path. Equation (3) and Equation (4) below indicate conditions in which the constructive interference is satisfied.

$$2n\pi(\text{with } n = 0, \pm 1, \pm 2, \ldots) = \frac{2h}{\lambda}2\pi \quad (3)$$

$$h = \frac{n\lambda}{2}, \quad (4)$$

where "λ" is a wavelength of the signal.

If a condition of $\Phi_1$, $\Phi_3$, or $\Phi_4$ changes, the gap between the dielectric layer 710 and the antenna element 740 may change.

Figure 8A:
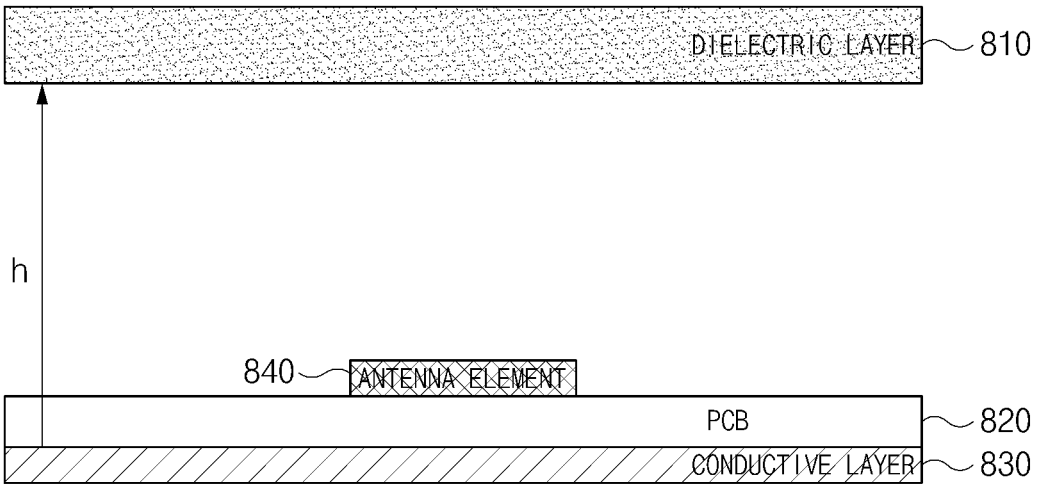
FIG. 8A is an illustration of an array structure of an antenna according to an embodiment.
Figure 8B:
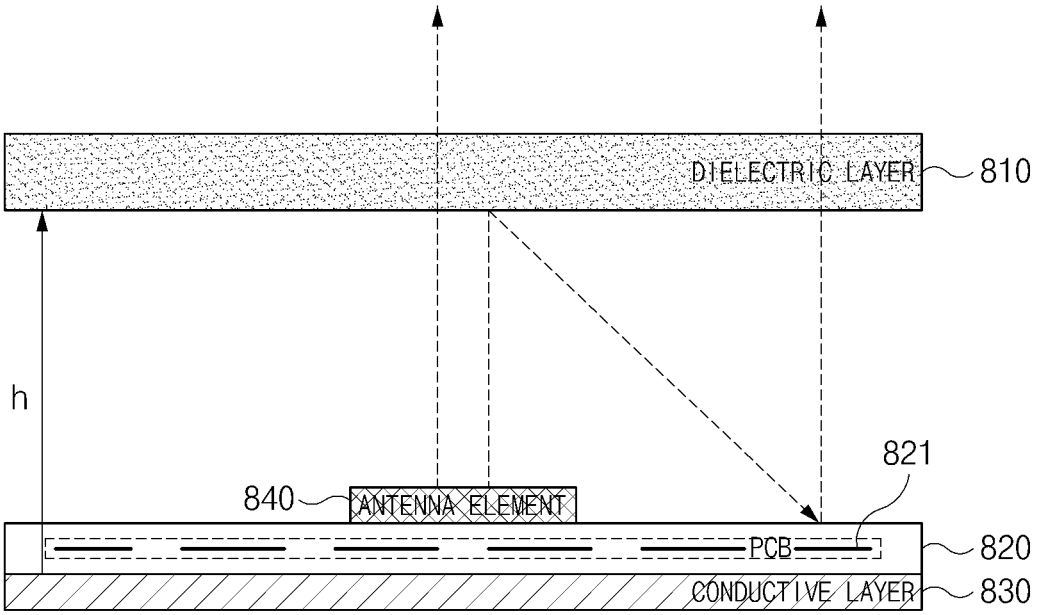
FIG. 8B is an illustration of an array structure of an antenna according to an embodiment.

FIGS. 8A and 8B are illustrations of a separation distance between an antenna element and a dielectric layer in an array structure of an antenna according to an embodiment.

Referring to FIGS. 8A and 8B, an electronic device 100 may include an antenna element 840 which may transmit and/or receive a signal in the mmWave band. The antenna element 840 may transmit or receive a signal through a dielectric layer 810.

The antenna element 840 may be interposed between the dielectric layer 810 and a conductive layer 830 and may be positioned on a PCB 820. The PCB 820 may be interposed between the antenna element 840 and the conductive layer 830. A configuration illustrated in FIG. 8A is an example, and various modifications according to various embodiments of the present disclosure may be possible. For example, the electronic device might not include the PCB 820 between the dielectric layer 810 and the conductive layer 830.

A free space (or a layer of air) may be defined between the antenna element 840 and the dielectric layer 810. The dielectric layer 810 may include the second plate 111 of FIG. 2 or the second plate 380 of FIG. 3. The dielectric layer 810 may be formed of a dielectric material having a certain permittivity (a first permittivity). For example, the second plate or the dielectric layer 810 may include a nonconductive material. The nonconductive material may include glass, polymer, or ceramic.

According to an embodiment, the PCB 820 and the conductive layer 830 may be a substrate positioned within a communication device 440. The PCB 820 may be a substrate like PCB (SLP). The PCB 820 in the communication device is illustrated in FIG. 8A, but the PCB 820 may be a main PCB such as the substrate 340 of FIG. 3.

According to an embodiment, the conductive layer 830 may be a conductive layer 446 positioned within a communication device 440 or a conductive layer formed on the substrate 340. A ground (GND) of the antenna element 840 may be formed at the conductive layer 830. The conductive layer 830 may include at least a portion of a support member (e.g., the first support member 311 or the second support member 360 of FIG. 3).

The antenna element 840 may constitute an antenna 450. The antenna element 840 may form a certain array (e.g., 1×2, 2×1, 2×2, or the like) together with any other antenna element. The antenna element may transmit and/or receive a signal which has a frequency ranging from 20 GHz to 100 GHz, and has a wavelength of λ. The antenna element 840 may be positioned on the PCB 820 so as to face the dielectric layer 810. The antenna element 840 may be a portion of a patch array antenna 455. With regard to a signal radiated from the antenna element 840, a phase difference between paths of a transmitted wave and a reflected wave may be a multiple of a wavelength λ.

A phase delay of 180° may occur in the signal radiated from the antenna element 840 due to the reflection at the conductive layer 830. In this case, the separation distance between the dielectric layer 810 and the antenna element 840 may satisfy the following Equation (5) and Equation (6).

$$2n\pi(\text{with } n = 0, \pm 1, \pm 2, \ldots) = \frac{2h}{\lambda}2\pi \quad (5)$$

$$h = \frac{n\lambda}{2} \quad (6)$$

In other words, the separation distance between the dielectric layer 810 and the antenna element may be identical or similar to a multiple of half the wavelength $$\frac{\lambda}{2}$$

at a minimum. According to an embodiment, n may be 1. That is, the separation distance between the dielectric layer 810 and the antenna element 840 may be identical or similar to half the wavelength. For example, if a wavelength is 5 mm, the separation distance between the dielectric layer 810 and the antenna element 840 may be within a given range (e.g., within a margin of error of 10%) from 2.5 mm.

A case where the antenna element 840 is interposed between the dielectric layer 810 and the PCB 820 and is positioned to face the dielectric layer 810 and the dielectric layer 810 is a second plate 380 is shown in FIG. 8A or 8B or in FIGS. 9 to 14, but the antenna element 840 may be positioned to face a side member 118. In this case, the antenna element 840 may be a portion of a dipole array antenna (e.g., the antenna element 456).

Referring to FIG. 8B, a structure in which a metamaterial is repeated may be interposed between the antenna element 840 and the conductive layer 830. For example, the electronic device may include a conductive element(s) 821 in the PCB 820.

The conductive element(s) 821 may be arranged in plurality. The conductive element(s) 821 may be arranged at a given interval and/or with a given size to form an artificial magnetic conductor (AMC). The conductive element(s) 821 may be interposed between the antenna element 840 and the conductive layer 830.

In a case where the AMC is formed by the conductive element(s) 821, a reflection coefficient (e.g., 1) of the conductive element(s) 821 may be different from a reflection coefficient (e.g., −1) of the conductive layer 830. Due to the reflection coefficient of the conductive element(s) 821, a phase of a signal reflected by the conductive element(s) 821 may be opposite to a phase of a signal reflected by the conductive layer 830 in FIG. 8A.

The separation distance between the antenna element 840 and the dielectric layer 810 may be a multiple of a phase delay wavelength by the conductive element(s) 821. As such, the separation distance between the antenna element 840 and the dielectric layer 810 may be identical or similar to $$\frac{\lambda}{4}.$$

The separation distance may vary with a thickness of the PCB 820 and/or the dielectric layer 810.

Figure 9:
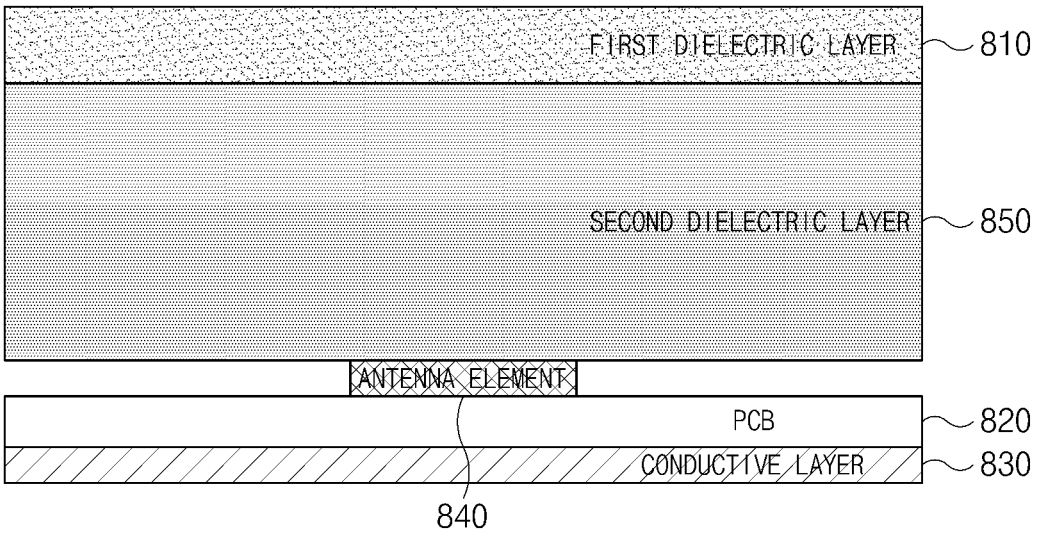
FIG. 9 is an illustration of an array structure of an antenna according to an embodiment.

FIG. 9 is an illustration of an array structure of an antenna according to an embodiment.

Referring to FIG. 9, an electronic device 100 may include the antenna element 840 which may transmit and/or receive a signal in the mmWave band.

A first dielectric layer 810, the PCB 820, the conductive layer 830, and the antenna element 840 of FIG. 9 are identical or similar to the dielectric layer 810, the PCB 820, the conductive layer 830, and the antenna element 840 of FIG. 8A, and thus, additional description is omitted to avoid redundancy.

An electronic device may further include a second dielectric layer 850 interposed between the first dielectric layer 810 and the antenna element 840. The second dielectric layer 850 may include a dielectric material having a dielectric constant $\varepsilon_r$. The dielectric material may include a polymetric material.

A wavelength of a signal at the second dielectric layer 850 may be shorter than in a case where the second dielectric layer 850 is absent. A signal radiated from the antenna element 840 may have a radio wave delay effect by a permittivity of the second dielectric layer 850. In other words, if the second dielectric layer 850 is added, since a distance of one wavelength of a signal decreases physically within a dielectric material, the permittivity of which is greater than that of air, the separation distance h for constructive interference between the first dielectric layer 810 and the antenna element 840 may decrease as much as the decrement.

A wavelength in the second dielectric layer 850 having the dielectric constant $\varepsilon_r$ may be expressed by the following Equation (7).

$$\lambda = \frac{c}{f\sqrt{\varepsilon\mu}}, \tag{7}$$

where f is a frequency, c is a speed of light constant ($3\times10^8$ m/s), ε is a permittivity of the second dielectric layer 850, and μ is a permeability of the second dielectric layer 850.

If the permittivity of the second dielectric layer 850 increases, a wavelength may decrease, or the separation distance between the first dielectric layer 810 and the antenna element 840 may decrease. In this case, an effective separation distance between the first dielectric layer 810 and the antenna element 840 may be half the wavelength. The effective separation distance may correspond to a value which is calculated based on a wavelength of a signal at least in the second dielectric layer 850. The effective separation distance may correspond to half of the wavelength changed at the second dielectric layer 850.

As illustrated in FIG. 9, the second dielectric layer 850 may be formed in such a way that the whole space between the antenna element 840 and the first dielectric layer 810 is filled, but the second dielectric layer 850 may be implemented in various forms.

Figure 10:
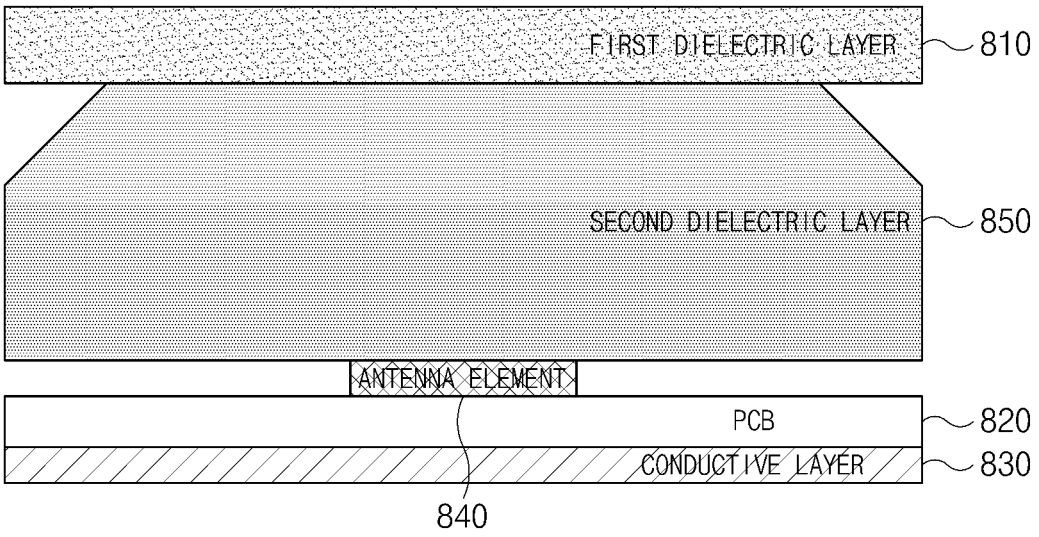
FIG. 10 is an illustration of an array structure of an antenna according to an embodiment.
Figure 11:
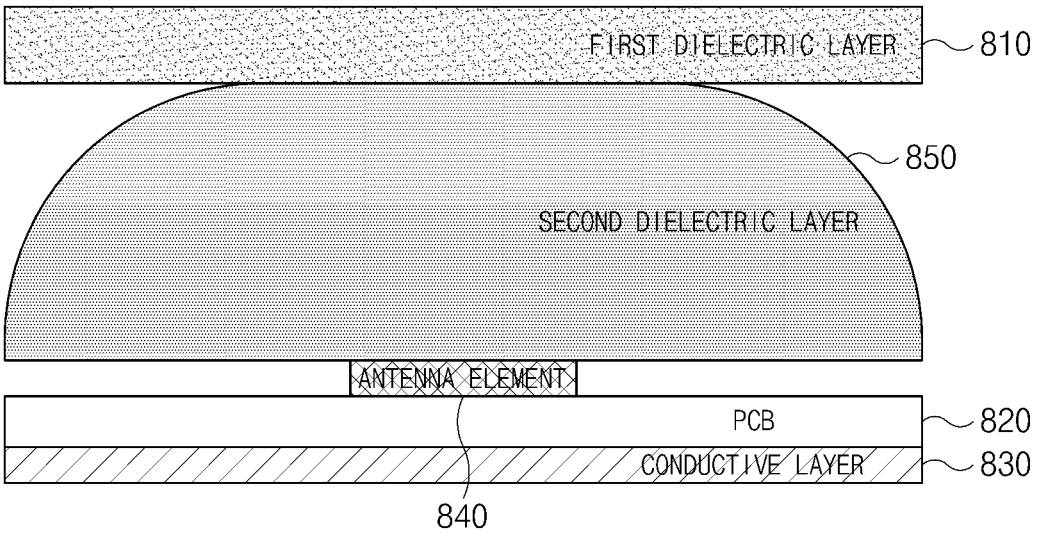
FIG. 11 is an illustration of an array structure of an antenna according to an embodiment.
Figure 12:
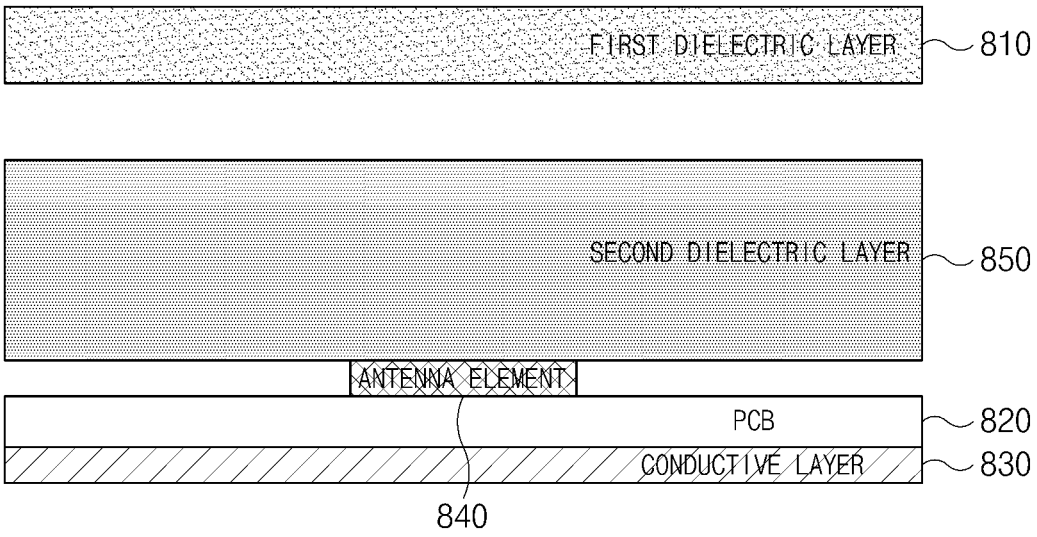
FIG. 12 is an illustration of an array structure of an antenna according to an embodiment.

FIGS. 10 to 12 are illustrations of how the second dielectric layer 850 is implemented, according to various embodiments.

Referring to FIG. 10, the second dielectric layer 850 may be implemented partially between the first dielectric layer 810 and the antenna element 840.

Referring to FIG. 11, an end portion of the second dielectric layer 850 may be in the form of a curved surface. If the second dielectric layer 850 is implemented in the form of a curved shape, a gain may be improved by a lens effect.

Referring to FIG. 12, the second dielectric layer 850 may fill a portion of a space from the antenna element 840 to the first dielectric layer 810. For example, the first dielectric layer 810 and the second dielectric layer 850 might not be in contact with each other, and a free space may be defined between the first dielectric layer 810 and the second dielectric layer 850.

Figure 13:
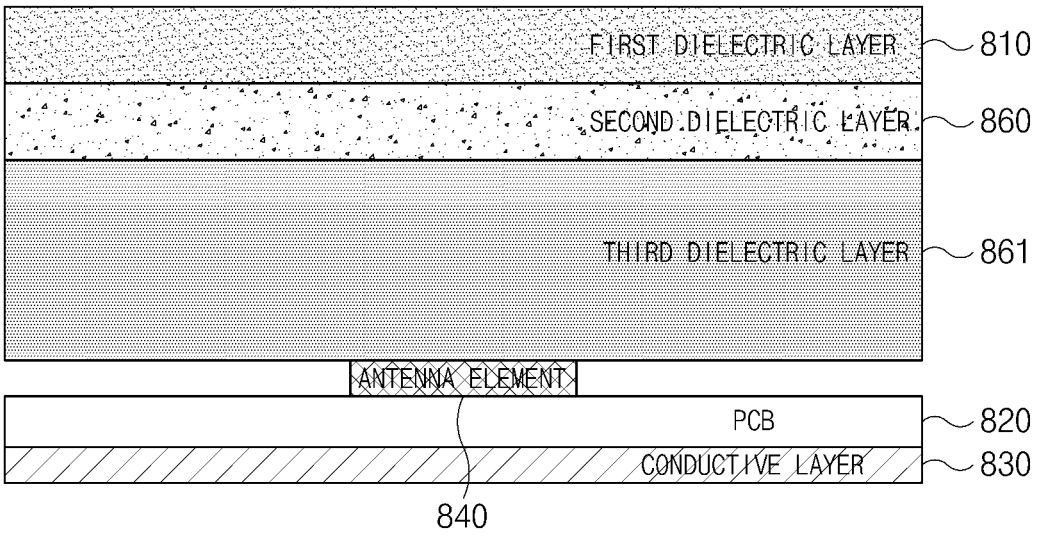
FIG. 13 is an illustration of an array structure of an antenna according to an embodiment.

FIG. 13 is an illustration of an array structure of an antenna according to an embodiment.

Referring to FIG. 13, an electronic device 100 may include the antenna element 840 which may transmit and/or receive a signal in the mmWave band.

The first dielectric layer 810, the PCB 820, the conductive layer 830, and the antenna element 840 of FIG. 13 are identical or similar to the dielectric layer 810, the PCB 820, the conductive layer 830, and the antenna element 840 of FIG. 8A, and thus, additional description is omitted to avoid redundancy.

The electronic device may include a plurality of dielectric layers having different dielectric constants (or relative permittivity) between the first dielectric layer 810 and the conductive layer 830. For example, the electronic device may include a second dielectric layer 860 having a first dielectric constant (or a relative permittivity) $\varepsilon_{r1}$ and a third dielectric layer 861 having a second dielectric constant (or a relative permittivity) $\varepsilon_{r2}$, between the first dielectric layer 810 and the antenna element 840.

The second dielectric layer 860 may be interposed between the third dielectric layer 861 and the first dielectric layer 810.

The second dielectric layer 860 and the third dielectric layer 861 may be formed of any medium except air.

In a case of including the plurality of dielectric layers, a phase difference between a transmitted wave and a reflected wave of a signal radiated from the antenna element 840 may be a multiple of a wavelength. In other words, the effective separation distance between the antenna element 840 and the first dielectric layer 810 may be half the wavelength.

The structure of FIG. 13 may be variously changed or modified according to various embodiments of the present disclosure. For example, a layer of air may be defined between the first dielectric layer 810 and the second dielectric layer 860.

Figure 14:
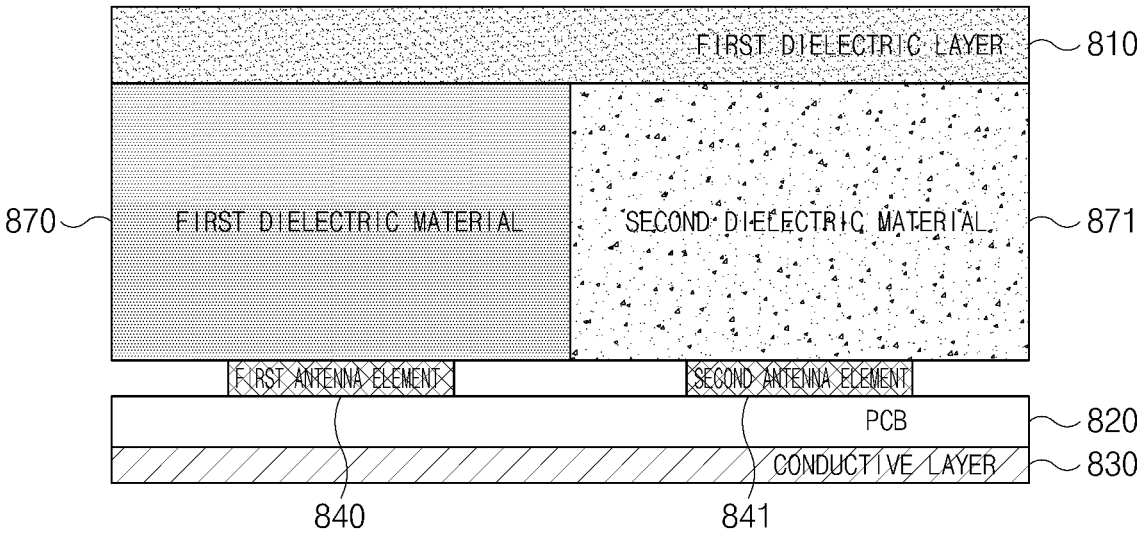
FIG. 14 is an illustration of an array structure of an antenna according to an embodiment.

FIG. 14 is an illustration of an array structure of an antenna according to an embodiment.

Referring to FIG. 14, an electronic device 100 may include, on the PCB 820, a plurality of antenna elements 457 which support two or more bands. For example, the electronic device may include a first antenna element 840 and a second antenna element 841. The first antenna element 840 and the second antenna element 841 may transmit and/or receive signals in different bands. The first antenna element 840 and the second antenna element 841 may transmit and/or receive signals in the mmWave band, and may transmit and/or receive signals in different frequency bands belonging to the mmWave band. In this case, the first antenna element 840 and the second antenna element 841 may constitute different antennas (e.g., the antenna 450 of FIG. 4A). In addition, the first antenna element 840 and the second antenna element 841 may constitute different array antennas.

The dielectric layer 810, the PCB 820, the conductive layer 830, and the first antenna element 840 of FIG. 14 are identical or similar to the dielectric layer 810, the PCB 820, the conductive layer 830, and the antenna element 840 of FIG. 8A, and, thus, additional description is omitted to avoid redundancy.

The second antenna element 841 may be interposed between the dielectric layer 810 and the PCB 820, and a frequency band of a signal which the second antenna element 841 transmits and/or receives may be different from a frequency band of a signal which the first antenna element 840 transmits and/or receives. The first antenna element 840 and the second antenna element 841 may be positioned in the same layer.

The first antenna element 840 and the second antenna element 841 may transmit and/or receive signals of different wavelengths, and a separation distance from the first antenna element 840 to the dielectric layer 810 may be identical to a separation distance from the second antenna element 841 to the dielectric layer 810. In this case, a phase difference between paths of a transmitted wave and a reflected wave of a signal radiated from the first antenna element 840 may correspond to a multiple of a wavelength, and a phase difference between paths of a transmitted wave and a reflected wave of a signal radiated from the second antenna element 841 may correspond to a multiple of a wavelength.

To this end, a plurality of dielectric materials having different dielectric constants may be interposed between the first and second antenna elements 840 and 841 and the dielectric layer 810. The plurality of dielectric materials may be arranged in parallel with each other to form one layer. For example, a first dielectric material 870 having a first dielectric constant (or a relative permittivity) $\varepsilon_{r1}$ and a second dielectric material 871 having a second dielectric constant (or a relative permittivity) $\varepsilon_{r2}$ may be included between the first and second antenna elements 840 and 841 and the dielectric layer 810.

For example, the first dielectric material 870 may be interposed between the first antenna element 840 and the dielectric layer 810, and the second dielectric material 871 may be interposed between the second antenna element 841 and the dielectric layer 810. An effective separation distance between the first antenna element 840 and the dielectric layer 810 may be identical to an effective separation distance between the second antenna element 841 and the dielectric layer 810 within a margin of error. In this case, a length of a first wavelength of a signal which penetrates the first dielectric material 870 after being radiated from the first antenna element 840 may be identical or similar to a length of a second wavelength of a signal which penetrates the second dielectric material 871 after being radiated from the second antenna element 841.

Figure 15:
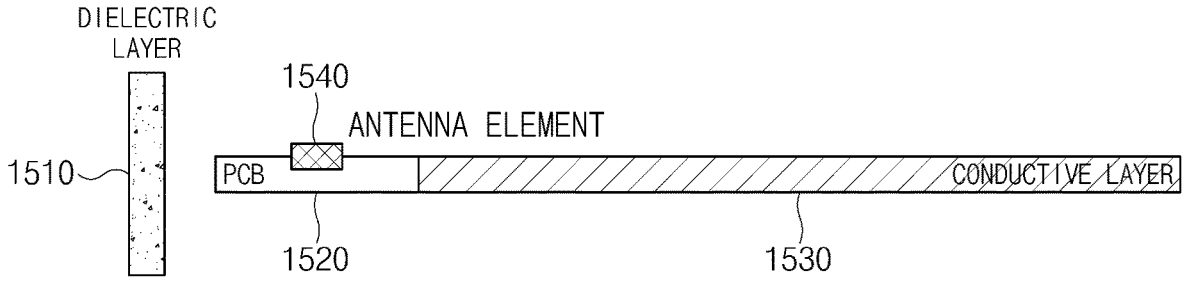
FIG. 15 is an illustration of an array structure of an antenna radiating a signal toward a side surface, according to an embodiment.

FIG. 15 is an illustration of an array structure of an antenna according to an embodiment.

Referring to HG. 15, an electronic device 100 may include an antenna element 1540 which may transmit and/or receive a signal in the mmWave band. According to an embodiment, the antenna element 1540 may be a portion of a dipole array antenna. The antenna element 1540 may radiate a signal toward a dielectric layer 1510.

The dielectric layer 1510 may include at least a portion of a side member 118. The dielectric layer 1510 may be formed of a dielectric material having a first permittivity. For example, the dielectric layer 1510 may include a nonconductive material 120 and 121 formed at a side member. The nonconductive material may include plastic.

The antenna element 1540 may be interposed between the dielectric layer 1510 and a conductive layer 1530, when viewed from above a second plate 111 or 380. The antenna element 1540 may be interposed between the second plate and a PCB 1520 to face the second plate. The antenna element 1540 may radiate or receive a signal through the dielectric layer 1510, and a radiation direction of the antenna element 1540 may be a direction perpendicular to the conductive layer 1530 or a lateral direction passing through the dielectric layer 1510. A radiation pattern of an array antenna composed of at least one antenna element 1540 may correspond to lateral radiation in which a radiation beam faces a dielectric layer direction.

A configuration of an electronic device illustrated in FIG. 15 is an example, and various modifications according to various embodiments of the present disclosure may be possible. For example, the electronic device might not include the PCB 1520 between the dielectric layer 1510 and the conductive layer 1530.

The PCB 1520 and the conductive layer 1530 may be a substrate positioned within a communication device 440. The PCB 1520 may be an SLP. The PCB 1520 in the communication device is illustrated in FIG. 15, but the PCB 1520 may be a main PCB such as the substrate 340 of FIG. 3.

The conductive layer 1530 may be a conductive layer 446 positioned within a communication device 440 or a conductive layer formed on the substrate 340 of FIG. 3. A GND of the antenna element 1540 may be formed at the conductive layer 1530.

A free space (or a layer of air) may be defined between the antenna element 1540 and the dielectric layer 1510. In this case, a phase difference between paths of a transmitted wave and a reflected wave of a signal radiated from the antenna element 1540 may be a multiple of a wavelength $\lambda$.

A separation distance between the antenna element 1540 and the dielectric layer 1510 may be half the wavelength.

The dielectric layer 1510 may include a plurality of nonconductive materials, and a width of each of the nonconductive materials may have a certain length. A separation distance between the antenna element 1540 and the dielectric layer 1510 may change due to a phase of a reflected wave which varies with the gap between the nonconductive materials.

An AMC may be included between the antenna element 1540 and the conductive layer 1530, or the conductive layer 1530 may include the AMC. In this case, the separation distance between the antenna element 1540 and the dielectric layer 1510 may be identical or similar to $$\frac{\lambda}{4}.$$

Figure 16:
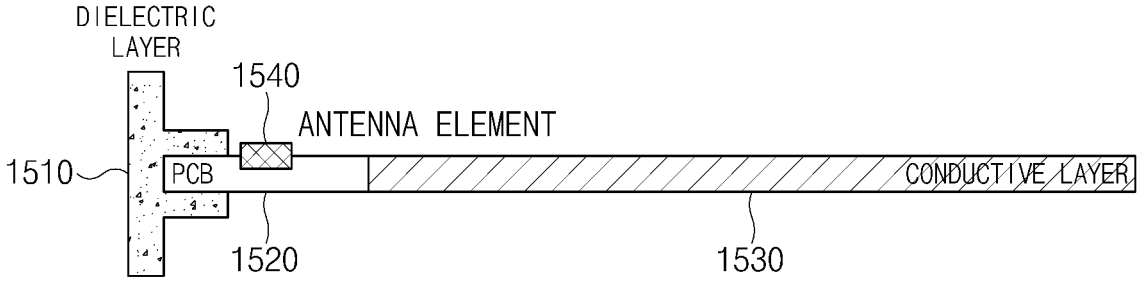
FIG. 16 is an illustration of an array structure of an antenna radiating a signal toward a side surface, according to an embodiment.
Figure 17:
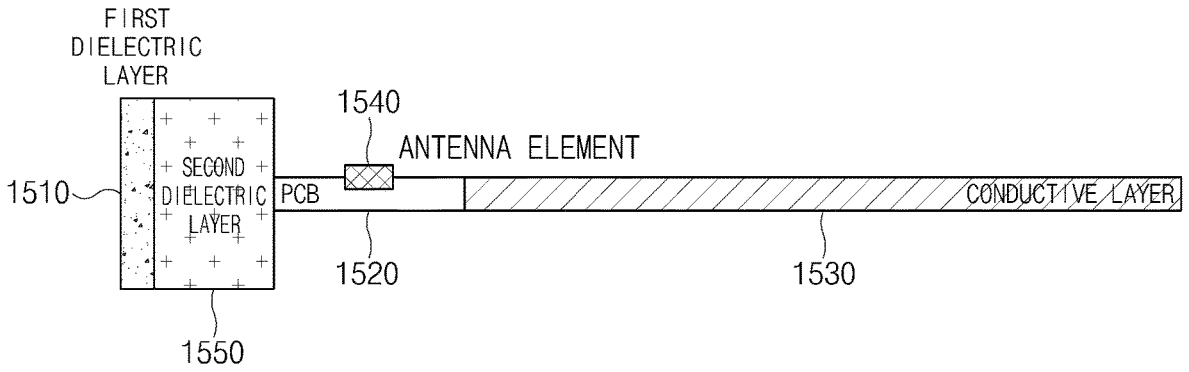
FIG. 17 is an illustration of an array structure of an antenna radiating a signal toward a side surface, according to an embodiment.

A case where the antenna element 1540 is interposed between the second plate and the PCB 1520 to face the second plate is shown in FIGS. 15 to 17, but the antenna element 1540 may be positioned to face the dielectric layer 1510. In this case, the antenna element 1540 may be a portion of a patch array antenna. A radiation pattern of the patch array antenna may correspond to front radiation in which a radiation beam faces a dielectric layer direction.

FIG. 16 is an illustration of an array structure of an antenna according to an embodiment.

Referring to FIG. 16, the dielectric layer 1510, the PCB 1520, the conductive layer 1530, and the antenna element 1540 are identical or similar to the dielectric layer 1510, the PCB 1520, the conductive layer 1530, and the antenna element 1540 of FIG. 15, and thus, additional description is omitted to avoid redundancy.

The dielectric layer 1510 may be positioned close to the antenna element 1540. For example, the dielectric layer 1510 which is a nonconductive material 120 and 121 of a side member 118 may be extended from a side surface 110C so as to be close to a communication device 440.

FIG. 17 is an illustration of an array structure of an antenna according to an embodiment.

Referring to FIG. 17, the first dielectric layer 1510, the PCB 1520, the conductive layer 1530, and the antenna element 1540 are identical or similar to the dielectric layer 1510, the PCB 1520, the conductive layer 1530, and the antenna element 1540 of FIG. 15, and thus, additional description is omitted to avoid redundancy.

A second dielectric layer 1550 which has a relative permeability different from a relative permeability of the first dielectric layer 1510 may be interposed between the antenna element 1540 and the first dielectric layer 1510. A signal which is radiated from the antenna element 1540 or is received by the antenna element 1540 may penetrate the first dielectric layer 1510 and the second dielectric layer 1550.

If the second dielectric layer 1550 is added, the separation distance between the antenna element 1540 and the first dielectric layer 1510 may decrease depending on the permittivity and/or the permeability of the second dielectric layer 1550.

Figure 18:
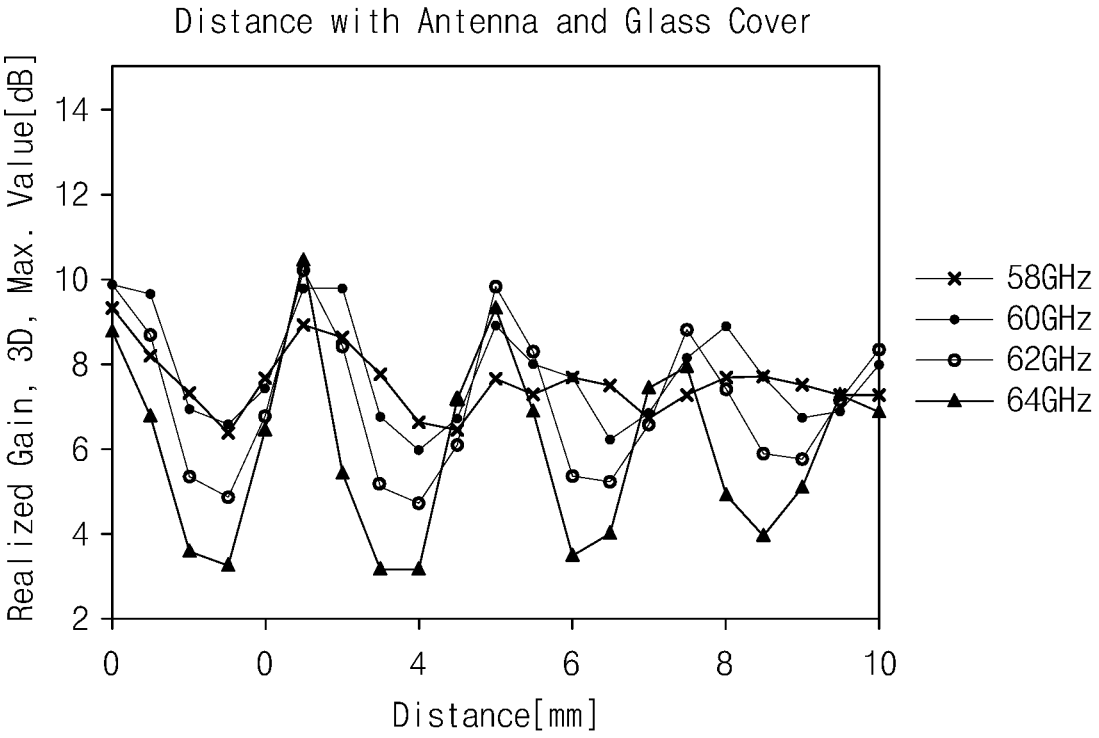
FIG. 18 is a graph of a relationship between a gain and a separation distance between an antenna and a dielectric layer, according to an embodiment.

FIG. 18 is a graph of a relationship between a gain and a separation distance between an antenna and a dielectric layer, according to an embodiment.

Referring to FIG. 18, a result of simulating a change of a gain according to a separation distance "h" between an antenna and a dielectric layer is shown, in a case where a wavelength of a signal transmitted from or received by an antenna is 5 mm and a free space is defined between the antenna and the dielectric layer.

A gain of the antenna increases sharply whenever the separation distance is a multiple of 2.5 mm, upon changing a frequency to 58 GHz, 60 GHz, 62 GHz, and 64 GHz. That is, when the separation distance between the antenna and the dielectric layer is a multiple of half the wavelength, the antenna gain may become high.

Figure 19:
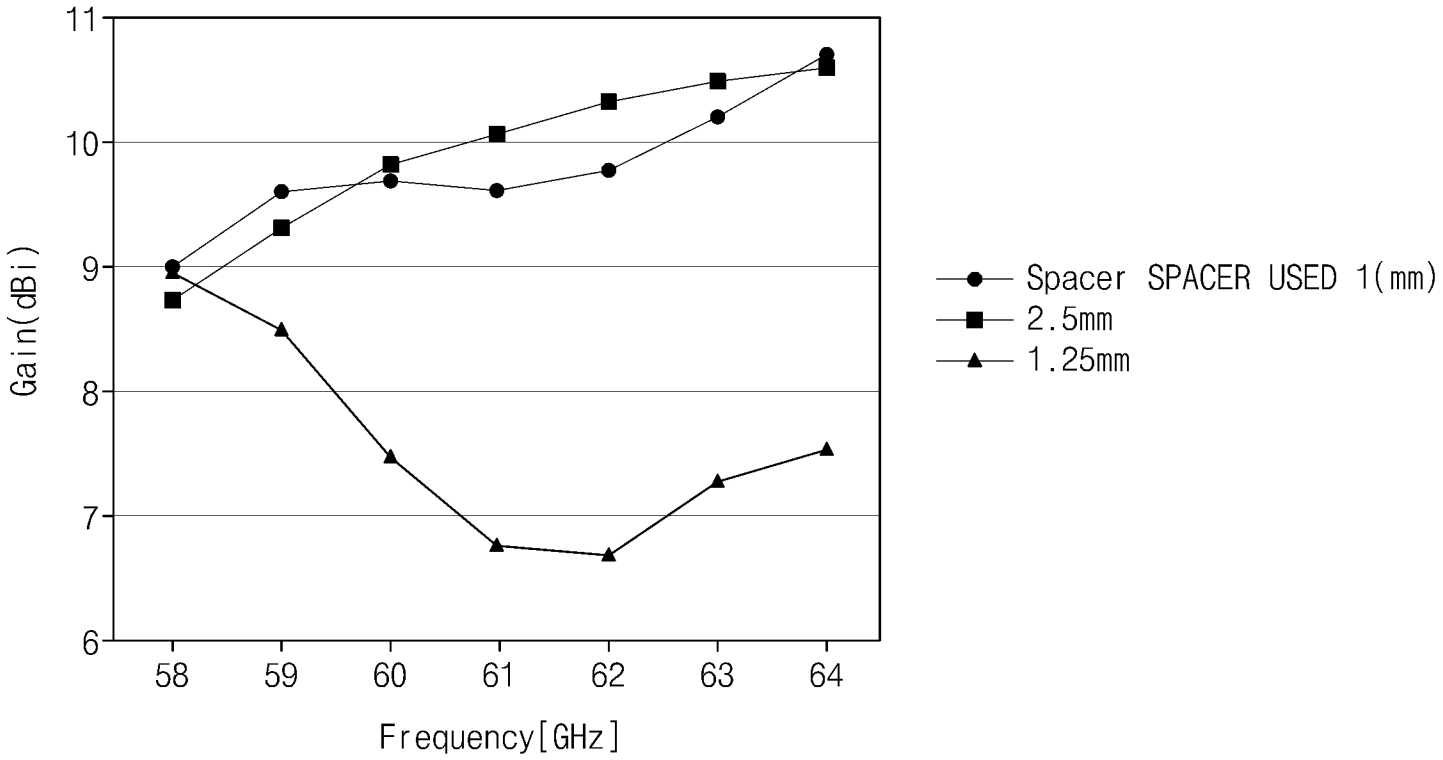
FIG. 19 is a graph of a relationship between a gain and a dielectric layer, according to an embodiment.

FIG. 19 is a graph of a relationship between a frequency and a gain in various situations, according to an embodiment.

Referring to FIG. 19, an antenna gain is shown for each frequency in a case where a wavelength of a signal transmitted from or received by an antenna is 5 mm, in the following situations: (a) a second dielectric layer which has a dielectric constant of 4 and is 1 mm thick is added between a first dielectric layer and the antenna (an effective separation distance is half of a wavelength of a transmit signal), (b) a gap between the antenna and the first dielectric layer is 2.5 mm (a separation distance is one-half a wavelength of a transmit signal), or (c) a gap between the first dielectric layer and the antenna is 1.25 mm.

An antenna gain when the second dielectric layer is added is similar to an antenna gain when a separation distance is half of a wavelength of a transmit signal. If a frequency increases, an antenna gain measured when the second dielectric layer is added or a separation distance is 2.5 mm becomes greater than an antenna gain measured when a gap between a dielectric layer and the antenna is 1.25 mm. That is, referring to FIGS. 18 and 19, an antenna gain becomes high when a separation distance is a multiple of half the wavelength and becomes high when a dielectric layer is added, even though a separation distance decreases.

According to an embodiment, an electronic device may include a housing that includes a first plate, a second plate facing the first plate and spaced from the first plate, and a side member surrounding a space between the first plate and the second plate, wherein the second plate includes a nonconductive material, at least one antenna element that is positioned within the space and is positioned on a substrate parallel to the second plate, wherein the at least one antenna element is spaced from the second plate by a certain gap h, and a wireless communication circuit that is electrically connected to the antenna element and transmits and/or receives a signal with a frequency between 20 GHz and 100 GHz and a wavelength corresponding to the frequency. The gap h may correspond to $$\frac{n\lambda}{2},$$

where n is an integer and λ is a wavelength.

The at least one antenna element may include an array of antenna elements positioned on the substrate.

The nonconductive material may include glass.

According to an embodiment, n may be 1.

The electronic device may further include a support member interposed between the second plate and the substrate.

The support member may include a conductive material.

The antenna element may transmit and/or receive a signal through the nonconductive material.

The antenna element may be positioned to face the second plate or to face the side member.

The electronic device may further include at least another antenna element that is positioned on the substrate and is spaced from the side member. The wireless communication circuit may be electrically connected to the other antenna element and transmit and/or receive, through the side member, a signal with a frequency between 20 GHz and 100 GHz and a wavelength of λ.

The other antenna element may be positioned to have a gap of $$\frac{\lambda}{2}$$

from the side member.

The side member may include another nonconductive material, and the wireless communication circuit may transmit and/or receive a signal through the other nonconductive material.

The electronic device may further include a plurality of conductive elements, and the other antenna element may be positioned to have a gap of $$\frac{\lambda}{4}$$

from the side member.

The other antenna element may be interposed between the side member and the plurality of conductive elements, when viewed from above the second plate.

The nonconductive material may include plastic.

According to an embodiment, an electronic device may include a housing that includes a first plate, a second plate facing the first plate and spaced from the first plate, and a side member surrounding a space between the first plate and the second plate, wherein the second plate includes a nonconductive material, at least one antenna element that is positioned within the space and is positioned on a substrate parallel to the second plate, wherein the at least one antenna element faces the second plate and is spaced from the second plate by a certain gap h, a wireless communication circuit that is electrically connected to the antenna element and transmits and/or receives a signal with a frequency between 20 GHz and 100 GHz and a first wavelength, and a dielectric material that is positioned in a certain gap h between the antenna element and the second plate and allows the signal to change to a second wavelength less than the first wavelength. The second wavelength may be defined as $$\lambda_2 = \frac{c}{f\sqrt{\varepsilon\mu}},$$

where f is a frequency of the signal, c is a speed of light constant (3×10^8 m/s), ε is a permittivity of the dielectric material, μ is a permeability of the dielectric material, and the gap h may correspond to $$\frac{n\lambda_2}{2},$$

and n is an integer.

The dielectric material may include a polymetric material.

The nonconductive material may include glass.

The nonconductive material may have a first dielectric constant, the dielectric material may have a second dielectric constant, and a ratio of the first dielectric constant and the second dielectric constant may be between 1/10 and 2/3.

The first dielectric constant may be between 2 and 5, and the second dielectric constant may be between 3 and 20.

According to an embodiment, an electronic device may include a housing that includes a first plate, a second plate facing the first plate and spaced from the first plate, and a side member surrounding a space between the first plate and the second plate, wherein the second plate includes a nonconductive material, at least one antenna element that is positioned within the space and is positioned on a substrate parallel to the second plate, wherein the at least one antenna element faces the second plate and is spaced from the second plate by a certain gap, a dielectric material that is positioned in the gap between the antenna element and the second plate, and a wireless communication circuit that is electrically connected to the antenna element and transmits and/or receives a signal with a frequency between 20 GHz and 100 GHz.

Figure 20:
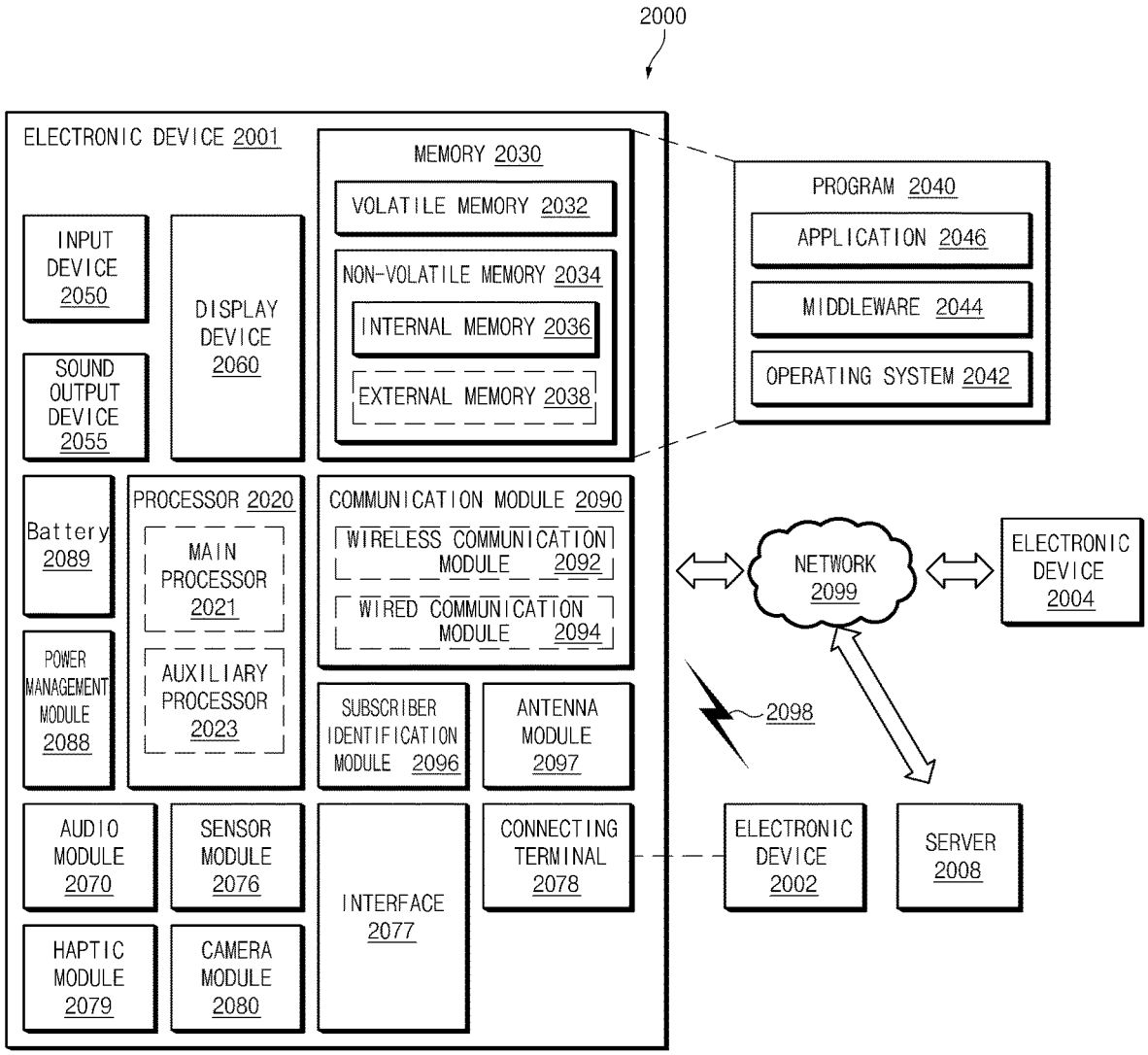
FIG. 20 is a block diagram of an electronic device in a network environment, according to an embodiment.

FIG. 20 is a block diagram of an electronic device 2001 in a network environment 2000 according to various embodiments. Referring to FIG. 20, the electronic device 2001 may communicate with an electronic device 2002 through a first network 2098 (e.g., a short-range wireless communication) or may communicate with an electronic device 2004 or a server 2008 through a second network 2099 (e.g., a long-distance wireless communication) in the network environment 2000. According to an embodiment, the electronic device 2001 may communicate with the electronic device 2004 through the server 2008. According to an embodiment, the electronic device 2001 may include a processor 2020, a memory 2030 an input device 2050, a sound output device 2055, a display device 2060, an audio module 2070, a sensor module 2076, an interface 2077, a haptic module 2079, a camera module 2080, a power management module 2088, a battery 2089, a communication module 2090, a subscriber identification module 2096, and an antenna module 2097. At least one component (e.g., the display device 2060 or the camera module 2080) among the components of the electronic device 2001 may be omitted or other components may be added to the electronic device 2001. According to some embodiments, some components may be integrated and implemented as in the case of the sensor module 2076 (e.g., a fingerprint sensor, an iris sensor, or an illuminance sensor) embedded in the display device 2060 (e.g., a display).

The processor 2020 may operate, for example, software (e.g., a program 2040) to control at least one of other components (e.g., a hardware or software component) of the electronic device 2001 connected to the processor 2020 and may process and compute a variety of data. The processor 2020 may load a command set or data, which is received from other components (e.g., the sensor module 2076 or the communication module 2090), into a volatile memory 2032, may process the loaded command or data, and may store result data into a nonvolatile memory 2034. The processor 2020 may include a main processor 2021 (e.g., a central processing unit (CPU) or an application processor (AP)) and an auxiliary processor 2023 (e.g., a graphic processing device, an image signal processor, a sensor hub processor, or a communication processor), which operates independently from the main processor 2021, additionally or alternatively uses less power than the main processor 2021, or is specified to a designated function. In this case, the auxiliary processor 2023 may operate separately from the main processor 2021 or embedded.

The auxiliary processor 2023 may control, for example, at least some of functions or states associated with at least one component (e.g., the display device 2060, the sensor module 2076, or the communication module 2090) among the components of the electronic device 2001 instead of the main processor 2021 while the main processor 2021 is in an inactive (e.g., sleep) state or together with the main processor 2021 while the main processor 2021 is in an active (e.g., an application execution) state. The auxiliary processor 2023 (e.g., the image signal processor or the communication processor) may be implemented as a part of another component (e.g., the camera module 2080 or the communication module 2090) that is functionally related to the auxiliary processor 2023. The memory 2030 may store a variety of data used by at least one component (e.g., the processor 2020 or the sensor module 2076) of the electronic device 2001, for example, software (e.g., the program 2040) and input data or output data with respect to commands associated with the software. The memory 2030 may include the volatile memory 2032 or the nonvolatile memory 2034.

The program 2040 may be stored in the memory 2030 as software and may include, for example, an operating system 2042, a middleware 2044, or an application 2046.

The input device 2050 may be a device for receiving a command or data, which is used for a component (e.g., the processor 2020) of the electronic device 2001, from an outside (e.g., a user) of the electronic device 2001 and may include, for example, a microphone, a mouse, or a keyboard.

The sound output device 2055 may be a device for outputting a sound signal to the outside of the electronic device 2001 and may include, for example, a speaker used for general purposes, such as multimedia play or recordings play, and a receiver used only for receiving calls. According to an embodiment, the receiver and the speaker may be either integrally or separately implemented.

The display device 2060 may be a device for visually presenting information to the user and may include, for example, a display, a hologram device, or a projector and a control circuit for controlling a corresponding device. According to an embodiment, the display device 2060 may include a touch circuitry or a pressure sensor for measuring an intensity of pressure on the touch.

The audio module 2070 may convert a sound and an electrical signal in dual directions. According to an embodiment, the audio module 2070 may obtain the sound through the input device 2050 or may output the sound through an external electronic device (e.g., the electronic device 2002, a speaker or a headphone) wired or wirelessly connected to the sound output device 2055 or the electronic device 2001.

The sensor module 2076 may generate an electrical signal or a data value corresponding to an operating state (e.g., power or temperature) inside or an environmental state outside the electronic device 2001. The sensor module 2076 may include, for example, a gesture sensor, a gyro sensor, a barometric pressure sensor, a magnetic sensor, an acceleration sensor, a grip sensor, a proximity sensor, a color sensor, an infrared sensor, a biometric sensor, a temperature sensor, a humidity sensor, or an illuminance sensor.

The interface 2077 may support a designated protocol wired or wirelessly connected to the external electronic device 2002. The interface 2077 may include, for example, an HDMI (high-definition multimedia interface), a USB (universal serial bus) interface, an SD card interface, or an audio interface.

A connecting terminal 2078 may include a connector that physically connects the electronic device 2001 to the external electronic device 2002, for example, an HDMI connector, a USB connector, an SD card connector, or an audio connector (e.g., a headphone connector).

The haptic module 2079 may convert an electrical signal to a mechanical stimulation (e.g., vibration or movement) or an electrical stimulation perceived by the user through tactile or kinesthetic sensations. The haptic module 2079 may include, for example, a motor, a piezoelectric element, or an electric stimulator.

The camera module 2080 may shoot a still image or a video image. According to an embodiment, the camera module 2080 may include, for example, at least one lens, an image sensor, an image signal processor, or a flash.

The power management module 2088 may be a module for managing power supplied to the electronic device 2001 and may serve as at least a part of a power management integrated circuit (PMIC).

The battery 2089 may be a device for supplying power to at least one component of the electronic device 2001 and may include, for example, a non-rechargeable (primary) battery, a rechargeable (secondary) battery, or a fuel cell.

The communication module 2090 may establish a wired or wireless communication channel between the electronic device 2001 and the external electronic device 2002, 2004, or the server 2008 and support communication execution through the established communication channel. The communication module 2090 may include at least one communication processor operating independently from the processor 2020 (e.g., the AP) and supporting the wired communication or the wireless communication. According to an embodiment, the communication module 2090 may include a wireless communication module 2092 (e.g., a cellular communication module, a short-range wireless communication module, or a GNSS (global navigation satellite system) communication module) or a wired communication module 2094 (e.g., an LAN (local area network) communication module or a power line communication module) and may communicate with the external electronic device using a corresponding communication module among them through the first network 2098 (e.g., the short-range communication network such as a Bluetooth, a WiFi direct, or an IrDA (Infrared Data Association)) or the second network 2099 (e.g., the long-distance wireless communication network such as a cellular network, an internet, or a computer network (e.g., LAN or WAN)). The above-mentioned various communication modules 2090 may be implemented into one chip or into separate chips, respectively.

According to an embodiment, the wireless communication module 2092 may identify and authenticate the electronic device 2001 using user information stored in the subscriber identification module 2096 in the communication network.

The antenna module 2097 may include one or more antennas to transmit or receive the signal or power to or from an external source. According to an embodiment, the communication module 2090 (e.g., the wireless communication module 2092) may transmit or receive the signal to or from the external electronic device through the antenna suitable for the communication method.

Some components among the components may be connected to each other through a communication method (e.g., a bus, a GPIO (general purpose input/output), an SPI (serial peripheral interface), or an MIPI (mobile industry processor interface)) used between peripheral devices to exchange signals (e.g., a command or data) with each other.

According to an embodiment, the command or data may be transmitted or received between the electronic device 2001 and the external electronic device 2004 through the server 2008 connected to the second network 2099. Each of the electronic devices 2002 and 2004 may be the same or different types as or from the electronic device 2001. According to an embodiment, all or some of the operations performed by the electronic device 2001 may be performed by another electronic device or a plurality of external electronic devices. When the electronic device 2001 performs some functions or services automatically or by request, the electronic device 2001 may request the external electronic device to perform at least some of the functions related to the functions or services, in addition to or instead of performing the functions or services by itself. The external electronic device receiving the request may carry out the requested function or the additional function and transmit the result to the electronic device 2001. The electronic device 2001 may provide the requested functions or services based on the received result as is or after additionally processing the received result. To this end, for example, a cloud computing, distributed computing, or client-server computing technology may be used.

The electronic device according to various embodiments disclosed in the present disclosure may be various types of devices. The electronic device may include, for example, at least one of a portable communication device (e.g., a smartphone), a computer device, a portable multimedia device, a mobile medical appliance, a camera, a wearable device, or a home appliance. The electronic device according to an embodiment of the present disclosure should not be limited to the above-mentioned devices.

It should be understood that various embodiments of the present disclosure and terms used in the embodiments do not intend to limit technologies disclosed in the present disclosure to the particular forms disclosed herein; rather, the present disclosure should be construed to cover various modifications, equivalents, and/or alternatives of embodiments of the present disclosure. With regard to description of drawings, similar components may be assigned with similar reference numerals. As used herein, singular forms may include plural forms as well unless the context clearly indicates otherwise. In the present disclosure disclosed herein, the expressions "A or B", "at least one of A or/and B", "A, B, or C" or "one or more of A, B, or/and C", and the like used herein may include any and all combinations of one or more of the associated listed items. The expressions "a first", "a second", "the first", or "the second", used in herein, may refer to various components regardless of the order and/or the importance, but do not limit the corresponding components. The above expressions are used merely for the purpose of distinguishing a component from the other components. It should be understood that when a component (e.g., a first component) is referred to as being (operatively or communicatively) "connected," or "coupled," to another component (e.g., a second component), it may be directly connected or coupled directly to the other component or any other component (e.g., a third component) may be interposed between them.

The term "module" used herein may represent, for example, a unit including one or more combinations of hardware, software and firmware. The term "module" may be interchangeably used with the terms "logic", "logical block", "part" and "circuit". The "module" may be a minimum unit of an integrated part or may be a part thereof. The "module" may be a minimum unit for performing one or more functions or a part thereof. For example, the "module" may include an application-specific integrated circuit (ASIC).

Various embodiments of the present disclosure may be implemented by software (e.g., the program 2040) including an instruction stored in a machine-readable storage media (e.g., an internal memory 2036 or an external memory 2038) readable by a machine (e.g., a computer). The machine may be a device that calls the instruction from the machine-readable storage media and operates depending on the called instruction and may include the electronic device (e.g., the electronic device 2001). When the instruction is executed by the processor (e.g., the processor 2020), the processor may perform a function corresponding to the instruction directly or using other components under the control of the processor. The instruction may include a code generated or executed by a compiler or an interpreter. The machine-readable storage media may be provided in the form of non-transitory storage media. Here, the term "non-transitory", as used herein, is a limitation of the medium itself (i.e., tangible, not a signal) as opposed to a limitation on data storage persistency.

According to an embodiment, the method according to various embodiments disclosed in the present disclosure may be provided as a part of a computer program product. The computer program product may be traded between a seller and a buyer as a product. The computer program product may be distributed in the form of machine-readable storage medium (e.g., a compact disc read only memory (CD-ROM)) or may be distributed only through an application store (e.g., a Play Store™). In the case of online distribution, at least a portion of the computer program product may be temporarily stored or generated in a storage medium such as a memory of a manufacturer's server, an application store's server, or a relay server.

Each component (e.g., the module or the program) according to various embodiments may include at least one of the above components, and a portion of the above sub-components may be omitted, or additional other sub-components may be further included. Alternatively or additionally, some components (e.g., the module or the program) may be integrated in one component and may perform the same or similar functions performed by each corresponding components prior to the integration. Operations performed by a module, a programming, or other components according to various embodiments of the present disclosure may be executed sequentially, in parallel, repeatedly, or in a heuristic method. Also, at least some operations may be executed in different sequences, omitted, or other operations may be added.

Figure 21:
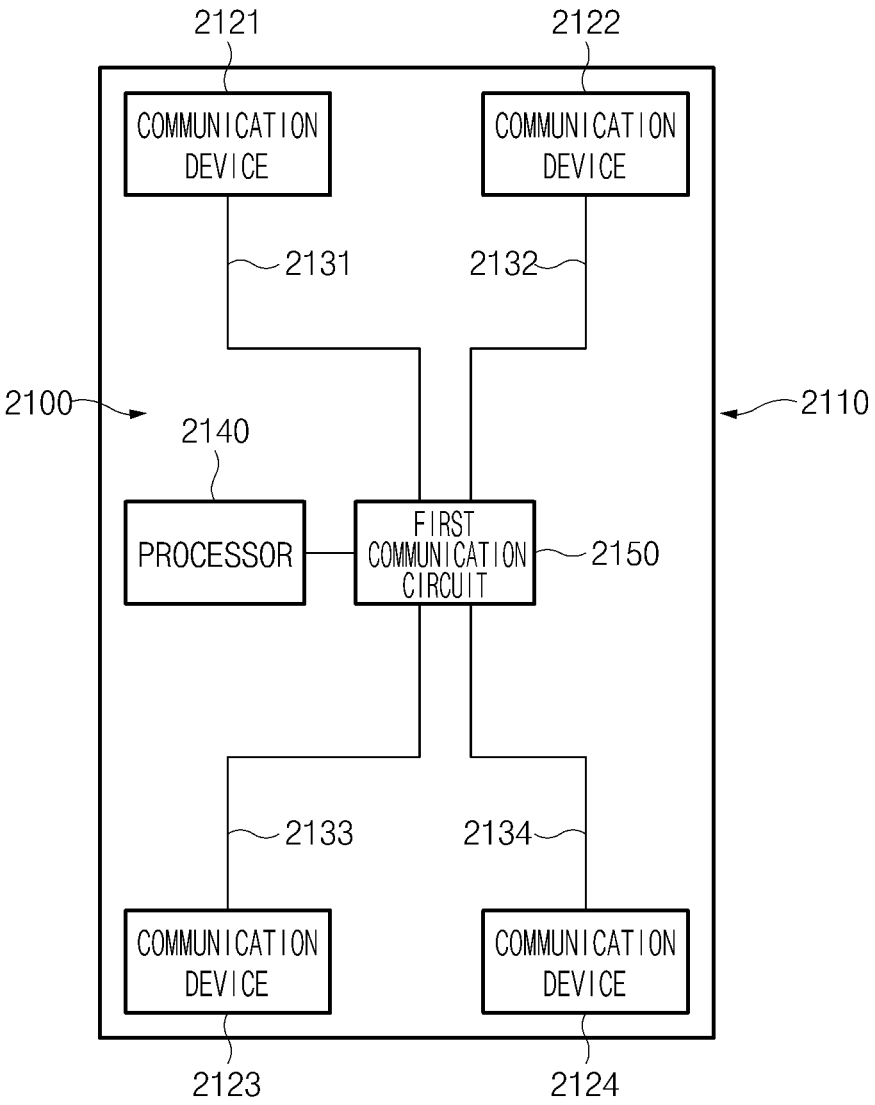
FIG. 21 is a block diagram of an electronic device supporting 5G communication.

FIG. 21 is a block diagram of an electronic device 2100 supporting 5G communication, according to an embodiment.

Referring to FIG. 21, the electronic device 2100 may include a housing 2110, a processor 2140, a first communication circuit 2150, a first communication device 2121, a second communication device 2122, a third communication device 2123, a fourth communication device 2124, a first conductive line 2131, a second conductive line 2132, a third conductive line 2133, or a fourth conductive line 2134. For example, the first communication device 2121, the second communication device 2122, the third communication device 2123, and the fourth communication device 2124 may be referenced as the communication device 440 of FIG. 4A.

The housing 2110 may protect any other components of the electronic device 2100. The housing 2110 may include, for example, a front plate, a back plate facing away from the front plate, and a side member (or a metal frame) surrounding a space between the front plate and the back plate. The side member may be attached to the back plate or may be integrally formed with the back plate.

The electronic device 2100 may include at least one communication device. For example, the electronic device 2100 may include the first communication device 2121, the second communication device 2122, the third communication device 2123, or the fourth communication device 2124.

The first communication device 2121, the second communication device 2122, the third communication device 2123, or the fourth communication device 2124 may be positioned within the housing 2110. When viewed from above the front plate of the electronic device 2100, the first communication device 2121 may be positioned at a left top end of the electronic device 2100, the second communication device 2122 may be positioned at a right top end of the electronic device 2100, the third communication device 2123 may be positioned at a left bottom end of the electronic device 2100, and the fourth communication device 2124 may be positioned at a right bottom end of the electronic device 2100.

The processor 2140 may include one or more of a CPU, an AP, a graphic processing unit (GPU), an image signal processor of a camera, or a baseband processor (or a communication processor (CP)). The processor 2140 may be implemented with a system on chip (SoC) or a system in package (SiP).

The first communication circuit 2150 may be electrically connected to at least one communication device by using at least one conductive line. For example, the first communication circuit 2150 may be electrically connected to the first communication device 2121, the second communication device 2122, the third communication device 2123, or the fourth communication device 2124 by using the first conductive line 2131, the second conductive line 2132, the third conductive line 2133, or the fourth conductive line 2134, respectively. The first communication circuit 2150 may include a baseband processor, an RFIC, or an inter-frequency integrated circuit (IFIC). The first communication circuit 2150 may include a baseband processor which is independent of the processor 2140 (e.g., an AP). The first conductive line 2131, the second conductive line 2132, the third conductive line 2133, or the fourth conductive line 2134 may include, for example, a coaxial cable or an FPCB.

The first communication circuit 2150 may include a first baseband processor (BP) or a second baseband processor. The electronic device 2100 may further include one or more interfaces for supporting inter-chip communication between the first BP (or the second BP) and the processor 2140. The processor 2140 and the first BP or the second BP may transmit/receive data by using the inter-chip interface (or an inter-processor communication channel).

The first BP or the second BP may provide an interface for performing communication with other entities. The first BP may support, for example, wireless communication with regard to a first network. The second BP may support, for example, wireless communication with regard to a second network.

The first BP or the second BP may form one module with the processor 2140. For example, the first BP or the second BP may be integrally formed with the processor 2140. For example, the first BP or the second BP may be positioned within one integrated circuit or chip or may be implemented in the form of an independent chip. The processor 2140 and at least one baseband processor (e.g., the first BP) may be integrally formed within one chip (a SoC), and another baseband processor (e.g., the second BP) may be implemented in the form of an independent chip.

The first network or the second network may correspond to the network 2099 of FIG. 20. The first network and the second network may include a 4G network and a 5G network, respectively. The 4G network may support, for example, long term evolution (LTE) protocol defined in the 3GPP. The 5G network may support, for example, a new radio (NR) protocol defined in the 3GPP.

Figure 22:
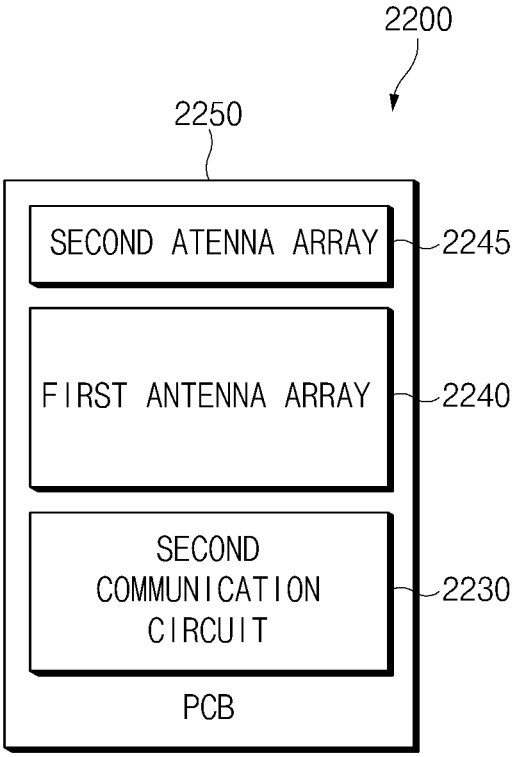
FIG. 22 is a block diagram of a communication device.

FIG. 22 is a block diagram of a communication device 2200, according to an embodiment.

Referring to FIG. 22, the communication device 2200 may include a second communication circuit 2230 (e.g., an RFIC), a PCB 2250, and at least one antenna array (e.g., a first antenna array 2240 or a second antenna array 2245).

A communication circuit or at least one antenna array may be positioned on the PCB 2250. For example, the first antenna array 2240 or the second antenna array 2245 may be positioned on a first surface of the PCB 2250, and the second communication circuit 2230 may be positioned on a second surface of the PCB 2250. The PCB 2250 may include a coaxial cable connector or a board to board (B-to-B) connector for electrical connection with another PCB (e.g., a PCB on which the first communication circuit 2150 of FIG. 21 is positioned) by using a transmission line (e.g., the first conductive line 2131 of FIG. 21 or a coaxial cable). For example the PCB 2250 may be connected to the PCB, on which the first communication circuit 2150 is positioned, and the coaxial cable may be used to transmit a receive/transmit IF signal or an RF signal. For example, power or any control signal may be provided through the B-to-B connector.

The first antenna array 2240 or the second antenna array 2245 may include a plurality of antenna elements. The plurality of antenna elements may include a patch antenna or a dipole antenna. For example, the plurality of antenna elements may include a dipole antenna having the structure described above with reference to FIG. 4B. For example, an antenna element included in the first antenna array 2240 may be a patch antenna for forming a beam toward a back plate of the electronic device 2100. For example, an antenna element included in the second antenna array 2245 may be a dipole antenna for forming a beam toward a side member of the electronic device 2100.

The communication circuit 2230 may support a frequency band ranging from 24 GHz to 30 GHz or ranging from 37 GHz to 40 GHz. The communication circuit 2230 may up-convert or down-convert a frequency. For example, a communication circuit included in the first communication device 2121 may up-convert an IF signal received from the first communication circuit 2150 through the first conductive line 2131. For example, the communication circuit may down-convert a millimeter wave signal received through the first antenna array 2240 or the second antenna array 2245 included in the first communication device 2121.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An electronic device, comprising:

a housing including a first plate, a second plate facing the first plate and spaced from the first plate, and a side member surrounding a space between the first plate and the second plate, wherein the second plate includes a nonconductive material;

at least one antenna element positioned within the space and positioned on a substrate parallel to the second plate, wherein the at least one antenna element is spaced from the second plate by a gap h;

a plurality of conductive elements provided within the substrate;

a conductive layer positioned on a side of the substrate opposite to the second plate; and a wireless communication circuit electrically connected to the antenna element and configured to transmit a signal with a frequency between 20 GHz and 100 GHz, wherein the plurality of conductive elements are arranged at a predetermined interval to form an artificial magnetic conductor, wherein at least one conductive element of the plurality of conductive elements is provided between the at least one antenna element and the conductive layer, wherein at least a portion of the signal transmitted by the at least one antenna element penetrates the second plate, wherein a remainder of the signal transmitted by the at least one antenna element is reflected by the second plate, and the remainder of the signal reflected by the second plate is reflected by the conductive layer, wherein the at least one antenna element includes:

a first antenna element configured to transmit and/or receive signals in a first mmWave band; and a second antenna element configured to transmit and/or receive signals in a second mmWave band which is different from the first mmWave band, wherein a first dielectric material having a first dielectric constant is interposed between the first antenna element and the second plate, and wherein a second dielectric material having a second dielectric constant which is different from the first dielectric constant is interposed between the second antenna element and the second plate.

2. The electronic device of claim 1, wherein the at least one antenna element includes an array of antenna elements positioned on the substrate.

3. The electronic device of claim 1, wherein the nonconductive material includes glass.

4. The electronic device of claim 1, further comprising:

a support member interposed between the second plate and the substrate.

5. The electronic device of claim 4, wherein the support member includes a conductive material.

6. The electronic device of claim 1, wherein the antenna element is positioned to face the second plate or to face the side member.

7. The electronic device of claim 1, further comprising:

at least another antenna element positioned on the substrate, and spaced from the side member, wherein the wireless communication circuit is electrically connected to the at least another antenna element and is configured to transmit and/or receive, through the side member, a signal with a frequency between 20 GHz and 100 GHz.

8. The electronic device of claim 7, wherein the at least another antenna element is positioned to have a gap of $\lambda/2$ from the side member.

9. The electronic device of claim 8, wherein the side member includes another nonconductive material, and wherein the wireless communication circuit is configured to transmit and/or receive a signal through the another nonconductive material.

10. The electronic device of claim 9, wherein the nonconductive material includes plastic.

11. The electronic device of claim 7, wherein the at least another antenna element is positioned to have a gap of $\lambda/4$ from the side member.

12. An electronic device, comprising:

a housing including a first plate, a second plate facing the first plate and spaced from the first plate, and a side member surrounding a space between the first plate and the second plate, wherein the second plate includes a nonconductive material;

at least one antenna element positioned within the space and positioned on a substrate parallel to the second plate, wherein the at least one antenna element faces the second plate and is spaced from the second plate by a gap h;

a plurality of conductive elements provided within the substrate;

a wireless communication circuit electrically connected to the antenna element and configured to transmit and/or receive a signal with a frequency between 20 GHz and 100 GHz and a first wavelength; and a dielectric material positioned in the gap h between the antenna element and the second plate and allowing the signal to change to a second wavelength less than the first wavelength, wherein the plurality of conductive elements are arranged at a predetermined interval to form an artificial magnetic conductor, wherein the at least one antenna element includes:

a first antenna element configured to transmit and/or receive signals in a first mmWave band; and a second antenna element configured to transmit and/or receive signals in a second mmWave band which is different from the first mmWave band, wherein the dielectric material includes:

a first dielectric material having a first dielectric constant; and a second dielectric material having a second dielectric constant which is different from the first dielectric constant, wherein the first dielectric material is interposed between the first antenna element and the second plate, and wherein the second dielectric material is interposed between the second antenna element and the second plate.

13. The electronic device of claim 12, wherein the dielectric material includes a polymetric material.

14. The electronic device of claim 12, wherein the nonconductive material includes glass.

15. The electronic device of claim 12, wherein the nonconductive material has a first dielectric constant and the dielectric material has a second dielectric constant, and wherein a ratio of the first dielectric constant and the second dielectric constant is between 1/10 and 2/3.

16. The electronic device of claim 15, wherein the first dielectric constant is between 2 and 5, and the second dielectric constant is between 3 and 20.

17. An electronic device, comprising:

a housing including a first plate, a second plate facing the first plate and spaced from the first plate, and a side member surrounding a space between the first plate and the second plate, wherein the second plate includes a nonconductive material;

at least one antenna element positioned within the space and positioned on a substrate parallel to the second plate, wherein the at least one antenna element faces the second plate and is spaced from the second plate by a gap;

a plurality of conductive elements provided within the substrate;

a conductive layer positioned on a side of the substrate opposite to the second plate;

a dielectric material positioned in the gap between the antenna element and the second plate; and a wireless communication circuit electrically connected to the antenna element and configured to transmit a signal, wherein the plurality of conductive elements are arranged at a predetermined interval to form an artificial magnetic conductor, wherein at least one conductive element of the plurality of conductive elements is provided between the at least one antenna element and the conductive layer, wherein at least a portion of the signal transmitted by the at least one antenna element penetrates the second plate, wherein a remainder of the signal transmitted by the at least one antenna element is reflected by the second plate, and the remainder of the signal reflected by the second plate is reflected by the conductive layer, wherein the at least one antenna element includes:

a first antenna element configured to transmit and/or receive signals in a first mmWave band; and a second antenna element configured to transmit and/or receive signals in a second mmWave band which is different from the first mmWave band, wherein the dielectric material includes:

a first dielectric material having a first dielectric constant; and a second dielectric material having a second dielectric constant which is different from the first dielectric constant, wherein the first dielectric material is interposed between the first antenna element and the second plate, and wherein the second dielectric material is interposed between the second antenna element and the second plate.

* * * * *